US010733816B2

(12) United States Patent
Hashemi et al.

(10) Patent No.: US 10,733,816 B2
(45) Date of Patent: Aug. 4, 2020

(54) ELECTRONICALLY CONTROLLED DRAWER SLIDE LOCKING FOR CABINETS AND HUB FOR SAME

(71) Applicant: Accuride International Inc., Santa Fe Springs, CA (US)

(72) Inventors: Darush David Hashemi, Trabuco Canyon, CA (US); Charles Milligan, Santa Fe Springs, CA (US); Lucas Nielsen, Santa Fe Springs, CA (US); Todd Takashi Watanabe, Santa Fe Springs, CA (US)

(73) Assignee: Accuride International Inc., Santa Fe Springs, CA (US)

( * ) Notice: Subject to any disclaimer, the term of this patent is extended or adjusted under 35 U.S.C. 154(b) by 0 days.

(21) Appl. No.: 15/215,462

(22) Filed: Jul. 20, 2016

(65) Prior Publication Data

US 2017/0024946 A1 Jan. 26, 2017
US 2018/0315264 A2 Nov. 1, 2018

Related U.S. Application Data

(60) Provisional application No. 62/194,685, filed on Jul. 20, 2015.

(51) Int. Cl.
*G07C 9/00* (2020.01)
*A47B 88/427* (2017.01)
(Continued)

(52) U.S. Cl.
CPC ..... *G07C 9/00182* (2013.01); *A47B 88/427* (2017.01); *A47G 29/141* (2013.01);
(Continued)

(58) Field of Classification Search
CPC ..... G07C 9/00182; G07C 2009/00634; A47G 29/141; A47G 29/20; A47G 88/457;
(Continued)

(56) References Cited

U.S. PATENT DOCUMENTS 4,933,613 A * 6/1990 Berner ..... G05D 3/127 318/102
5,225,825 A * 7/1993 Warren ..... G07C 9/0069 221/125

(Continued)

FOREIGN PATENT DOCUMENTS

CN 102812193 A 12/2012
CN 104470403 A 3/2015

OTHER PUBLICATIONS

International Search Report on related PCT Application No. PCT/US2016/043193 from International Searching Authority (KIPO) dated Oct. 20, 2016.

(Continued)

*Primary Examiner* — Daniel J Troy
*Assistant Examiner* — Timothy M Ayres
(74) *Attorney, Agent, or Firm* — Klein, O'Neill & Singh, LLP

(57) ABSTRACT

A locking system for a cabinet may include a plurality of hubs to pass signals from activation devices and for power distribution to locks controlling access to drawers and/or openings of the cabinet. The hubs may also pass signals between pairs of locks, for example for drawer slides used for drawers of the cabinets. In some embodiments the hubs passively pass the signals, and in some embodiments each of the hubs are identical.

26 Claims, 16 Drawing Sheets

(51) Int. Cl.
*A47G 29/14* (2006.01)
*A47G 29/20* (2006.01)
*A47B 88/457* (2017.01)

(52) U.S. Cl.
CPC ..... *A47G 29/20* (2013.01); *G07C 9/00912* (2013.01); *A47B 88/457* (2017.01); *A47G 2029/146* (2013.01); *G07C 2009/00634* (2013.01); *G07C 2009/00793* (2013.01)

(58) Field of Classification Search
CPC ..... A47G 2029/146; A47B 88/457; E05B 65/462; E05B 47/00
USPC ..... 312/215
See application file for complete search history.

(56) References Cited

U.S. PATENT DOCUMENTS 5,359,322 A * 10/1994 Murray ..... E05B 65/46 340/5.5
5,389,919 A * 2/1995 Warren ..... G07C 9/0069 109/7
5,433,000 A * 7/1995 Tamura ..... H05K 1/115 174/261
5,896,508 A * 4/1999 Lee ..... G06F 13/387 370/434
6,869,664 B2 * 3/2005 Vasoya ..... B32B 5/26 428/209
7,445,255 B2 * 11/2008 Nye-Hingston .... E05B 15/0205 292/144
7,719,214 B2 * 5/2010 Leehey ..... G05B 19/042 318/286
8,179,228 B2 * 5/2012 Colley, III ..... G07C 9/00896 340/5.54
8,403,376 B2 3/2013 Greiner et al.
2007/0188303 A1 8/2007 Faro et al.
2011/0234371 A1 9/2011 Linton et al.
2011/0315766 A1 12/2011 Phillips et al.
2012/0056572 A1 * 3/2012 Bigler ..... H02K 5/225 318/570
2012/0133510 A1 5/2012 Pierce et al.
2013/0069514 A1 * 3/2013 Hashemi ..... E05B 47/00 312/333
2013/0278122 A1 10/2013 Edwards et al.
2014/0021843 A1 * 1/2014 Hashemi ..... E05B 47/0001 312/333
2014/0320259 A1 10/2014 Marsden
2015/0179006 A1 6/2015 Von Zurmuehlen et al.
2015/0194002 A1 7/2015 Kaczmarz et al.

OTHER PUBLICATIONS

Written Opinion on related PCT Application No. PCT/US2016/043193 from International Searching Authority (KIPO) dated Oct. 20, 2016.
Office action on related Chinese Application No. 201680049375.4 from the China National Intellectual Property Administration (CNIPA) dated Jan. 28, 2019.
Extended European Search Report on related European Application No. 16828493.3 from the European Patent Office (EPO) dated Jul. 13, 2018.
Office action on related Chinese Application No. 201680049375.4 from the China National Intellectual Property Administration (CNIPA) dated Sep. 10, 2019.
Office action on related Chinese Application No. 201680049375.4 from the China National Intellectual Property Administration (CNIPA) dated Mar. 18, 2020.

* cited by examiner

ELECTRONICALLY CONTROLLED DRAWER SLIDE LOCKING FOR CABINETS AND HUB FOR SAME

CROSS REFERENCE TO RELATED APPLICATIONS

This application claims the benefit of the filing date of U.S. Provisional Patent Application No. 62/194,685, filed on Jul. 20, 2015, the disclosure of which is incorporated by reference herein.

BACKGROUND OF THE INVENTION

This invention relates generally to cabinetry, and more particularly, to access of cabinetry using electronically actuated drawer slides with locks and/or electronically actuated locks.

Cabinets often include doors or drawers for enclosed storage space for various items. At times control of access to the enclosed storage space may be desired, for example in retail or other environments. The control of access may be desired to limit access to appropriate persons, to determine time when access was made, or a variety of other reasons.

Unfortunately, devices providing control of access to the enclosed storage space may present difficulties. The devices may be burdensome to install or use, or may insufficiently control access to the enclosed storage space. For example, if enclosed storage space, such as cabinetry, includes more than one drawer or door, wiring and distribution of signals, including power, to various locking devices may present difficulties. Moreover, a facility, for example a retail facility, may include many cabinets for which control of access is desired, and the cabinets may include a number of different cabinets of varying configurations, for example in terms of numbers and positions of drawers and doors. Control of locking devices, and installation of the control system, for such a situation may be complex.

BRIEF SUMMARY OF THE INVENTION

In some embodiments a locking system for a cabinet comprises: an RFID reader; a power converter; a plurality of hubs serially coupled between the RFID reader and the power converter; and a plurality of pairs of drawer slides, each of the drawer slides including a lock with processor control, with each pair of drawer slides coupled to a corresponding one of the plurality of hubs.

In some embodiments each hub includes ports for passage of power signals, RFID reader activation signals, and, in some embodiments, drawer slide activation and/or status signals. In some embodiments the hubs pass signals between ports on a passive basis. In some embodiments the hubs are active, and amplify, boost, or condition at least some of the signals. In some embodiments the hubs receive power at a first port, and pass power to all of the other ports. In some embodiments the hubs receive RFID signals at a second port, and pass the RFID signals to all of the other ports. In some embodiments the hubs receive drawer slide activation or status signals from a first drawer slide on a third port, and pass the activation or status signals to a fourth port. In some embodiments the hubs receive drawer slide activation or status signals from a second drawer slide on the fourth port, and pass the activation or status signals to the third port.

In some embodiments each hub is coupled to locks of a pair of drawer slides. In some embodiments each drawer slide has its own associated processor for control of operation of its lock. In some embodiments the processor is housed in a same housing as the lock.

In some embodiments a locking system for a cabinet comprises: an RFID reader; a power converter; a plurality of hubs serially coupled between the RFID reader and the power converter; and a plurality of locks each with its own processor for use in control of the locks, with each lock coupled to a hub. In some embodiments each hub may be coupled to one or two locks. In some embodiments at least some of the locks may be locks for drawer slides.

Some aspects of the invention provide an embodiment of a locking system for a cabinet comprising: an RFID reader; a power converter; a plurality of hubs coupled in series between the RFID reader and the power converter, each of the hubs including ports for passage of power signals and an RFID activation signal; and a plurality of pairs of drawer slides; a locking mechanism for each drawer slide of the plurality of pairs of drawer slides, each locking mechanism including a housing and a processor for use in controlling operation of a lock of the locking mechanism, with each housing for each pair of the drawer slides electrically coupled to a corresponding one of the plurality of hubs.

Some aspects of the invention provide an embodiment of a locking system for a cabinet comprising: an authentication device; a power converter; at least one hub coupled between the authentication device and the power converter, each of the at least one hub including ports for passage of power signals and an authentication device activation signal; and at least one pair of drawer slides; a locking mechanism for each drawer slide of the at least one pair of drawer slides, each locking mechanism electrically coupled to a corresponding one of the at least one hub.

Some aspects of the invention provide an embodiment of a locking system for a cabinet comprising: an authentication device; a power converter; at least one hub coupled between the authentication device and the power converter; and a plurality of locks, at least partially controlled by at least one processor for use in control of the locks, with each lock coupled to a one of the plurality of hubs.

Some aspects of the invention provide an embodiment of a locking system for a cabinet comprising: an authentication device; a power converter; a plurality of hubs coupled between the authentication device and the power converter; and a plurality of pairs of drawer slides, each of the drawer slides including a lock with processor control, with each pair of drawer slides coupled to a corresponding one of the plurality of hubs.

Some aspects of the invention provide an embodiment of a system for use in controlling operation of locking devices of a cabinet, comprising: a plurality of electromechanical locking devices; a plurality of identical hubs, each of the hubs including a plurality of ports interconnected by predefined signal paths; and a plurality of cables having connectors at each end, at least some of the cables connecting the plurality of hubs by way of the ports, at least some other of the cables connecting at least some of the hubs to at least some of the plurality of electromechanical locking devices; at least one cable connecting a first of the hubs to an authentication device, and at least one cable connecting a second of the hubs to a power converter.

These and other aspects of the invention are more fully comprehended upon review of this disclosure.

DETAILED DESCRIPTION

Figure 1:
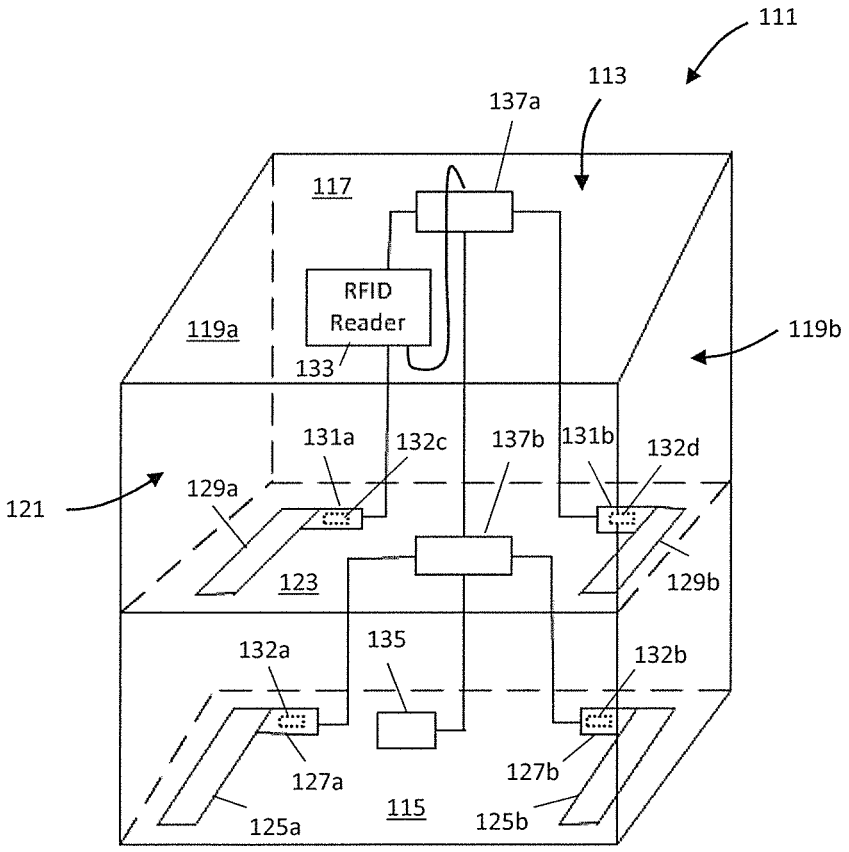
FIG. 1 is a semi-block diagram of a locking system for a cabinet in accordance with aspects of the invention.

Some aspects of the invention provide a system for controlling locking of drawers and/or doors of a cabinet. In some embodiments, a plurality of drawer slide locks and/or door locks are unlocked, at least temporarily, by a trigger signal provided by an RFID reader. A signal distribution network is used to distribute signals, including power signals, to and between the RFID reader and the locks. The signal distribution network includes signal lines and at least one hub, and in many embodiments multiple hubs. In some embodiments a hub is provided for each drawer and for each pair of doors.

In some embodiments power is provided by a power converter, which for example converts AC utility or line power to DC power, or which may regulate DC power, for example from a battery in some embodiments. The power converter is coupled to the RFID reader and the locks by the signal distribution network.

In some embodiments each hub includes four ports, which may be variously in the form of connection sockets and/or cable pigtails, with for example connectors at their ends. The ports may be considered to form a pair of vertical connector ports, upper and lower, and a pair of side ports, for example connector sockets, left and right. In most embodiments connection points of the vertical connector ports are connected by signal paths within the hub, as are some of the connection points of the side connector sockets. The hub may therefore be considered as having vertical signal paths and horizontal signal paths. In addition, the vertical signal paths are also cross coupled to other of the connection points of the horizontal connector sockets.

In many embodiments, the power converter is effectively coupled to one of the vertical connector ports, for example the lower connector port, and the RFID reader is effectively coupled to the other of the vertical connector ports, for example the upper connector port. Each of the side connectors sockets may be effectively coupled to a lock.

In some embodiments a single hub is used to pass signals to a plurality of locks in a cabinet, and in some embodiments all locks of a cabinet. In some embodiments the hub, whether a single hub or a plurality of hubs include at least one processor for use in controlling operation of the locks. In some embodiments hubs, locks, and other electrical components are coupled together by way of cables of predefined lengths and having snap-in connectors, which may allow for, for example, increased ease of installation. In some embodiments the snap-in connectors of the cables have a male connector on one end and a female connector on an opposing end. In some embodiments each hub includes three ports with female connector sockets and one port with a pigtail cable having a male connector. In some embodiments hubs are serially connected, in some embodiments hubs are connected in parallel, and in some embodiments some hubs are connected serially and some hubs are connected in parallel.

In many embodiments, multiple hubs are used, with the multiple hubs daisy chained together using signal lines, for example cables, connected between upper and lower connector slots of different hubs. In such embodiments, for example, the power converter may be coupled by a cable to a lower connector socket of a first hub, an upper connector socket of the first hub may be coupled to a lower connector socket of a second hub, an upper connector socket of the second hub may be coupled by a cable to a lower connector socket of a third hub, and so on, until finally an upper connector socket of an nth hub is coupled by a cable to the RFID reader. In many of such embodiments, side connectors of each of the first hub, second hub, and so on to nth hub may also be connected by cables to locks, which may be for drawer slides. The locks, for example, may be as discussed in U.S. Patent Application No. 62/104,665, entitled ELECTRO-MECHANICAL LATCHING/LOCKING WITH INTEGRATED TOUCH/PUSH ACTIVATION, filed on Jan. 16, 2015, incorporated herein by reference for all purposes.

In some such embodiments, the power converter may provide power using a power line and a ground line, and the RFID reader may provide a trigger signal on a trigger line. In such embodiments the signal paths for the vertical connector sockets may be coupled by three lines, with one line each used for the power line, ground line, and trigger line. As these signals may also be made available to the locks in some embodiments, each of these lines, in addition to coupling connections of the vertical connector sockets, may also be coupled to connections of the side connector sockets. Moreover, in various embodiments each lock of a pair of locks for a particular cabinet may communicate status to each other, and so connection of opposing side connectors may also have dedicated signal paths. In some embodiments each side connector includes two such signal paths, each of which is generally used to communicate lock status information in an opposing direction. For example, in one embodiment each lock provides a signal to its paired lock indicating whether a touch and release (T/R) action has been performed for that side.

FIG. 1 is a semi-block diagram of a locking system for a cabinet 111 in accordance with aspects of the invention. The cabinet includes a top 113 and a bottom 115, with the top and bottom interconnected by side walls 119*a,b*. The cabinet includes a front opening 121, and a rear wall 117, which interconnects both the top and bottom and the two side walls. As illustrated, the cabinet includes an interior space for two drawers, one over the other, with a horizontal dividing wall 123 bisecting the interior space. For simplicity of exposition with regard to FIG. 1, the cabinet is shown configured for use with only two drawers. In various embodiments, however, the cabinet may include more than two drawers, may include doors without drawers at all, may include any number of drawers and any number of doors, and may include drawers and/or doors in side-by-side and/or over-and-under and side-by-side configurations.

The drawers (not shown in FIG. 1 for clarity) are coupled to the cabinet by drawer slides, so as to be extendible from the cabinet, through extension of the drawer slides. A first pair of drawer slides 125*a,b* are on the bottom of the cabinet, with a lower drawer normally mounted on the first pair of drawer slides. Similarly, a second pair of drawer slides 129*a,b* are on the horizontal dividing wall, with an upper drawer normally mounted to the second pair of drawer slides. In practice, it may be noted, the drawer slides may be mounted to the surface on which they are on, or a flange extending from a rail of the drawer slides may instead be used to allow actual mounting of the drawer slides to side walls or side frame members of the cabinet. As the drawer slides are under their respective drawers, they may be considered undermount slides. In various embodiments side-mounted slides, positioned along sides of the drawers and which may be variously telescopic slides, over-and-under slides, or other slides, may instead be used.

Each of the drawer slides 125*a,b* and 129*a,b* of FIG. 1 includes an associated lock, locks 127*a,b* and 131*a,b*, respectively as shown in FIG. 1. The locks each include their own processor 132*a-d* for control of operation of the locks. In some embodiments each processor is housed in a housing for that lock. In some embodiments the processors are configured, for example by program instructions, to unlock the drawer slides, allowing one rail of a drawer slide to extend relative to another rail of the drawer slide, upon receipt of an activation signal, which may be termed a trigger signal. In some embodiments the processors are configured to unlock the drawer slides for a period of time, for example several seconds, after receipt of an activation signal. In some embodiments the processors are configured to unlock the drawer slides upon receipt of an activation signal, and to place the lock in a locking state after receiving an indication of drawer opening (which may be an indication of drawer slide rail extension). In some embodiments the processors are configured to allow for unlocking of the drawer slides upon receipt of an activation signal, with the processors also configured to unlock the drawer slides upon receipt of a further signal, for example a signal from a switch indicating that the drawer has been pressed inward in the cabinet.

The activation signal is provided by an RFID reader 133. The RFID reader serves to sense presence of an RFID chip, for example in an RFID card, proximate the reader, and to determine if the RFID chip is appropriately encoded for the RFID reader to generate an activation signal. In various embodiments, however, the RFID reader may be replaced by some other wireless or near field communication device, or by a keypad, biometric reader, or other physical input device; all of which may be considered an authentication device.

As illustrated in FIG. 1, the RFID reader is mounted to a top of the cabinet. In various embodiments the RFID reader may be mounted within the cabinet, on a face of the cabinet, or in other positions. The RFID reader is coupled, by a first cable, to a first hub 137*a*. In the embodiment of FIG. 1, the first hub is shown as positioned on the rear wall in the interior of the cabinet, behind the upper drawer. The first hub includes a plurality of ports, four as illustrated in FIG. 1, with the first cable to the RFID connected to one of the ports, an upper port as illustrated. As will be discussed more fully below, the first cable also provides power to the RFID reader, distributed through the first hub.

The first hub distributes the activation signal from the upper port to other ports of the hub. In the case of the first hub of FIG. 1, the other ports may be considered as including a bottom port and a pair of side ports, for example a left side port and a right side port. The left side port is coupled, by a second cable, to the lock 131*a* of the drawer slide 129*a* for the upper drawer, and the right side port is coupled, by a third cable, to the lock 131*b* of the drawer slide 129*b*, also for the upper drawer. The first hub therefore distributes the activation signal (and power, as will be discussed) to the locks for the pair of drawer slides for the upper drawer.

In addition, in some embodiments the hub is also configured to pass one or more signals from the left side port to the right side port, and to pass one or more signals from the right side port to the left side port. In some such embodiments the left side port and the right side port are coupled by two signal lines, and the signal lines may be used to each uni-directionally pass a lock status signal from one drawer slide lock to the other drawer slide lock. For example, in one embodiment the lock status signal is a signal indicating whether a drawer has been pressed inward into the cabinet, or, in another embodiment whether the lock is in an unlocked state.

A second hub 137*b* is also coupled to the first hub, by a fourth cable. In some embodiments the fourth cable is a pigtail cable extending from the first hub. In the embodiment of FIG. 1, the second hub is shown as positioned on the rear wall in the interior of the cabinet, behind the lower drawer. The second hub is identical to the first hub, and therefore also includes a plurality of ports, four as illustrated in FIG. 1, and which may be considered the upper port, left side port, right side port, and bottom port. In the embodiment of FIG. 1, the upper port of the second hub is coupled, by the fourth cable, to the bottom port of the first hub. The second hub therefore receives the RFID activation signal from the first hub, and distributes the activation signal to other ports of the second hub.

As with the first hub, the left side port and the right side port are coupled, by fifth and sixth cable respectively, to the locks 127*a,b* of the pair of drawer slides 125*a,b* for the lower drawer. The second hub therefore distributes the activation signal (and power, as will be discussed) to the locks for the pair of drawer slides for the lower drawer.

Also as with the first hub, considering that the first hub and second hub are identical, the second hub is in some embodiments configured to pass one or more signals from the left side port to the right side port, and vice versa.

As should be understood from above discussion, presence of additional drawers in the cabinet, with corresponding drawer slides and locks having processor control, may be supported by coupling further hubs in series with the first and second hubs, with locks for pairs of drawer slides coupled to each hub. In addition, in various embodiments doors may be used in place of some or all of the drawers, with the hubs being used to distribute the activation signal (and power as will be shortly be discussed) to locks for the doors. In addition, in various embodiments only a single lock may be associated with some or all of the hubs.

Returning to discussion of the second hub, the bottom port of the second hub is coupled, by a seventh cable, to a source power, a power converter 135 in various embodiments. The power converter, which may be coupled to a battery or AC utility line power (both not shown), provides DC power to the system. The second hub includes signal paths to distribute the power to the other ports of the second hub, thereby providing power to the locks of the pair of drawer slides for the lower drawer by way of the left side port and right side port, as well as providing power to the first hub by way of the upper port. The first hub similarly includes the same signal paths, such that power is distributed to the RFID reader by way of the top port, and to the locks of the pair of drawer slides for the upper drawer.

From the foregoing, it may be seen that each hub includes signal paths for the RFID activation signal and the power signal between all ports, and signal paths for lock coordination between a pair of ports, for example the left side and right side ports as discussed. In some embodiments two wires are used for conveyance of the power signal, a single wire for conveyance of the RFID activation signal, and a single wire each (for a total of two wires) for conveyance of a coordination signal from one lock to another lock. In such embodiments, therefore, the upper and bottom port may each include three connections (2 for the power signal and 1 for the RFID activation signal), while the side ports may each include five connections (2 for the power signal, 1 for the RFID activation signal, 1 for communication of lock status from the left drawer slide lock to the right drawer slide lock, and 1 for communication of lock status from the right drawer slide lock to the left drawer slide lock).

Moreover, in various embodiments the hubs may utilize standardized connectors, as may the locks, the RFID reader, and the power converter.

Figure 2A:
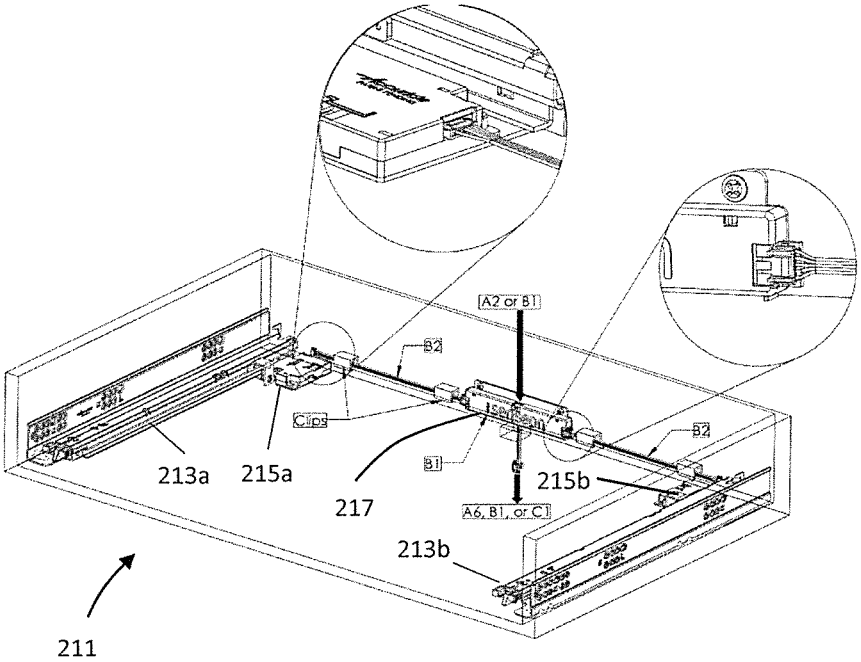
FIG. 2A is an isometric view of a portion of an embodiment of a locking system for a cabinet, shown for a single opening with dual controlled undermount drawer slides, in accordance with aspects of the invention.

FIG. 2A shows one embodiment of a portion of a locking system for controlling locking of drawers and/or doors of a cabinet. In particular, the illustrated embodiment shows an opening for a single drawer of a cabinet, shown with an undermount drawer slide configuration. In the illustrated embodiment, a pair of drawer slides 213*a*, 213*b* are mounted on opposite sides of a cabinet opening. A pair of locks, drawer slide locks, or lock mechanisms 215*a*, 215*b* engage with the pair of drawer slides 213*a*, 213*b*, respectively. A hub 217 is mounted to a rear wall of the opening, just above a floor of the opening. The hub is coupled to the lock mechanisms 215*a*, 215*b* via cables. In various embodiments the cables are selected from a set of cables of various predefined lengths. The hub 217 can be mounted with fasteners, adhesive, or other attachment devices. The lock mechanisms 215*a*, 215*b* are attached to the drawer slides 213*a*, 213*b*, or spaced and detached from the drawer slides 213*a*, 213*b* in some embodiments. The lock mechanisms 215*a*, 215*b* can be mounted to the floor or rear wall of the opening of the cabinet. Each lock mechanism 215*a*, 215*b* may be equipped with a processor for control purposes, as is the case for the embodiment of FIG. 2A, although in some embodiments a processor of the hub may be used in control of the locks instead. A drawer (not shown) can be attached to the pair of drawer slide 213*a*, 213*b* which allows the drawer to be opened from the front of the cabinet portion and contents therein accessed. The drawer slides 213*a*, 213*b* can telescopically extend the drawer. The cables and hub 217 preferably do not obstruct the path of the drawer from the closed position to a fully opened position. Clips can be used to tie the cables to the rear or floor of the cabinet portion. The cables have connectors at opposite ends connected to the input of the lock mechanisms 215*a*, 215*b* at one end and the hub 217 at the other end.

Specifically as shown, the left lock mechanism 215*a* is connected to the left side of the hub 217 and the right lock mechanism 215*b* is connected to the right side of the hub 217. A cable also extends from the top of the hub and the bottom of the hub to connect serially to other hubs, power supply, or any other device communicating with the locking system. The lock mechanisms 215*a*, 215*b*, when activated, engage with the drawer or the drawer slides 213*a*, 213*b* to prevent the drawer from being opened. In some embodiments, a single locking mechanism 215*a* can be used to lock the drawer when closed, with each drawer slide 213*a* coupled to a hub 217. In some embodiments each drawer slide 213*a*, 213*b* has its own associated processor for control of operation of its lock mechanism 215*a*, 215*b*. In some embodiments the processor is housed in a same housing as the lock mechanism 215*a*, 215*b*.

The lock mechanisms 215*a*, 215*b* can be unlocked, at least temporarily, by an activation or trigger signal provided by an RFID reader (not shown) attached to the hub 217. A signal distribution network is used to distribute signals, including power signals, to and between the RFID reader and the locks. The signal distribution network includes signal lines and at least one hub 217, and in other embodiments multiple hubs 217. In some embodiments, a single hub 217 is provided for each drawer and for one door or each pair of doors. In other embodiments, a single hub 217 can distribute signals used to unlock multiple drawers and doors.

In some embodiments power is provided by a power converter, which for example converts AC utility or line power to DC power. The power converter is coupled to the RFID reader and the locks by the signal distribution network via the hub 217.

In some embodiments, each hub 217 includes a plurality of ports for passage of power signals, RFID reader activation signals, and, in some embodiments, drawer slide activation and/or status signals. In some embodiments the hubs 217 pass signals between ports on a passive basis. In some embodiments the hubs 217 are active, and amplify, boost, or condition at least some of the signals. In some embodiments the hubs 217 receive power at a first port, and pass power to all of the other ports. In some embodiments the hubs 217 receive RFID signals at a second port, and pass the RFID signals to all of the other ports 217. In some embodiments the hubs 217 receive drawer slide activation or status signals from a first drawer slide on a third port, and pass the activation or status signals to a fourth port. In some embodiments the hubs 217 receive drawer slide activation or status signals from a second drawer slide on the fourth port, and pass the activation or status signals to the third port.

In the illustrated embodiment of FIG. 2A, four ports or connection sockets are shown which may be considered to form a pair of vertical connector slots, upper and lower, and a pair of side connector sockets, left and right. In most embodiments connection points of the vertical connector sockets are connected by signal paths within the hub 217, as are some of the connection points of the side connector sockets. The hub 217 may therefore be considered as having vertical signal paths and horizontal signal paths. In addition, the vertical signal paths are also cross coupled to other of the connection points of the horizontal connector sockets.

In many embodiments, the power converter is effectively coupled to one of the vertical connector sockets, for example the lower connector socket, and the RFID reader is effectively coupled to the other of the vertical connector sockets, for example the upper connector slot. Each of the side connectors sockets may be effectively coupled to one or more lock mechanism 215*a*, 215*b*.

In many embodiments, multiple hubs 217 are used, with the multiple hubs daisy chained together using signal lines, for example cables, connected between upper and lower connector slots of different hubs 217. In such embodiments, for example, the power converter may be coupled by a cable to a lower connector socket of a first hub 217, an upper connector socket of the first hub 217 may be coupled to a lower connector socket of a second hub 217, an upper connector socket of the second hub 217 may be coupled by a cable to a lower connector socket of a third hub 217, and so on, until finally an upper connector socket of an nth hub 217 is coupled by a cable to the RFID reader. In many of such embodiments, side connectors of each of the first hub 217, second hub 217, and so on to nth hub 217 may also be connected by cables to locks, which may be for drawer slides. Each hub 217 may be identical or different depending on the application of the particular hub 217.

In some such embodiments, the power converter may provide power using a power line and a ground line, and the RFID reader may provide a trigger signal on a trigger line. In such embodiments the signal paths for the vertical connector sockets may be coupled by three lines, with one line each used for the power line, ground line, and trigger line. As these signals may also be made available to the locks in some embodiments, each of these lines, in addition to coupling connections of the vertical connector sockets, may also be coupled to connections of the side connector sockets. Moreover, in various embodiments each lock mechanism 215*a*, 215*b* of a pair of lock mechanisms 215*a*, 215*b* for a particular cabinet portion may communicate status to each other, and so connection of opposing side connectors may also have dedicated signal paths. In some embodiments each side connector includes two such signal paths, each of which is generally used to communicate lock status information in an opposing direction. For example, in one embodiment each lock provides a signal to its paired lock indicating whether a touch and release (T/R) action has been performed for that side.

Figure 2B:
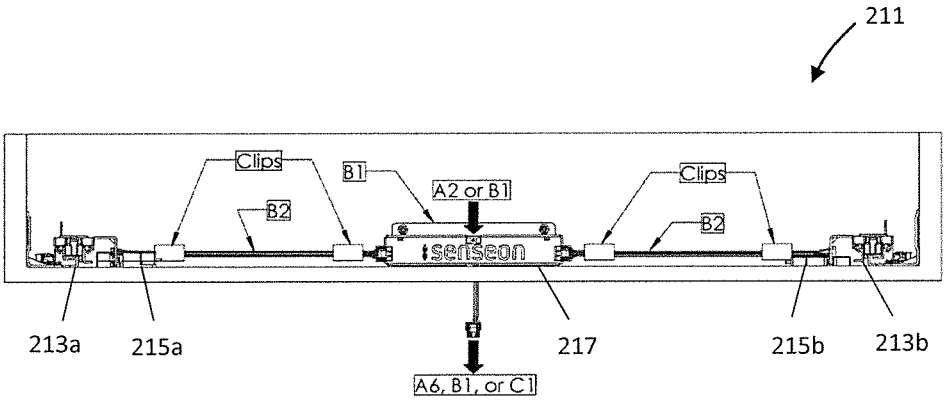
FIG. 2B is a front view of the locking system of FIG. 2A in accordance with aspects of the invention.

FIG. 2B shows a front view of the locking system 211 with the hub 217, the lock mechanisms 215*a*, 215*b*, and the drawer slides 213*a*, 213*b* positioned at or about a floor of an opening of a cabinet. As shown the drawer slides 213*a*, 213*b* are mounted to a side wall of the opening, for example by way of a flange of one rail of the drawer slide, against or close to the floor of the opening with the lock mechanisms 215*a, b* adjacent or attached to the drawer slides 213*a*, 213*b*. The cables coupling the locking mechanisms 215*a*, 215*b* to the hub 217 generally extend in a straight line to reduce cable length. Slack in the cables may be provided to ease assembly and disassembly of the connectors of the cables from the hub 217 or locking mechanisms 215*a*, 215*b*. The cables connected to the lower connector slot of the hub may extend beneath a mounting floor as shown or extend out a rear or a side of the cabinet portion. The cables can be managed by cable clips to prevent interference with the operation of the drawer. The hub 217 may be mounted to the rear, side, or floor of the cabinet portion. The drawer slides 213*a*, 213*b* may be mounted to the floor or sides of the cabinet portion.

Figure 2C:
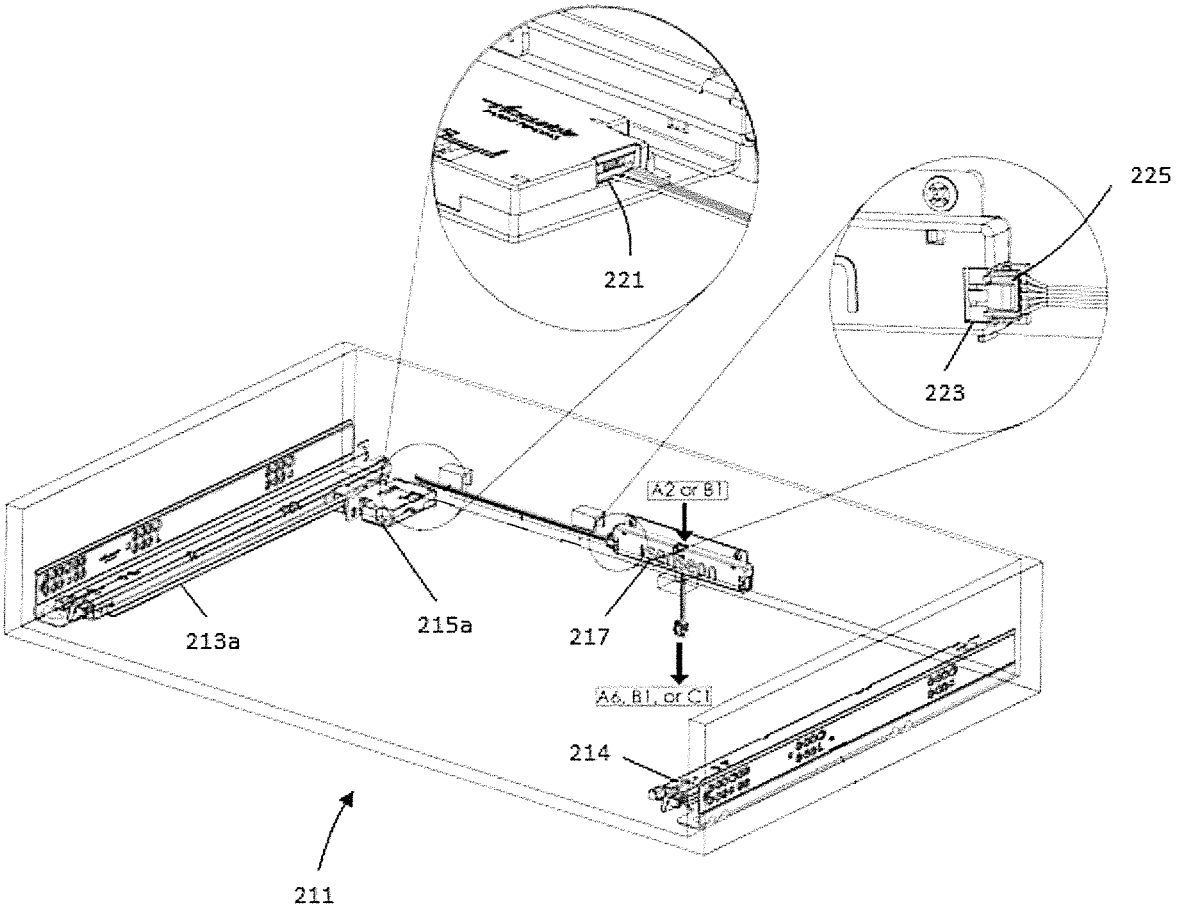
FIG. 2C is an isometric view of a portion of another embodiment of a locking system for a cabinet, shown for a single opening with dual undermount drawer slides, of which a single undermount drawer slide is controlled, in accordance with aspects of the invention.

FIG. 2C is similar to the embodiment of FIG. 2A, except that the locking system 211 utilizes only one lock mechanism 215*a* attached to one of the pair of drawer slides 213*a*, with a second drawer slide 214 of the pair of drawer slides operated without a lock. The left port 223 of the hub 217 is connected directly to the lock input 221 of the lock mechanism 215*a* by a single cable having connectors 225 at its ends. In various embodiments both ends of the cable may use the same connector type, in other embodiments different connector types may be used at different ends of the cable. The connectors 225 can be latching connectors, which may for example provide a slight click when inserted, with for example a small tab on the connector allowing for release of the connector from the lock mechanism or the hub.

Figure 2D:
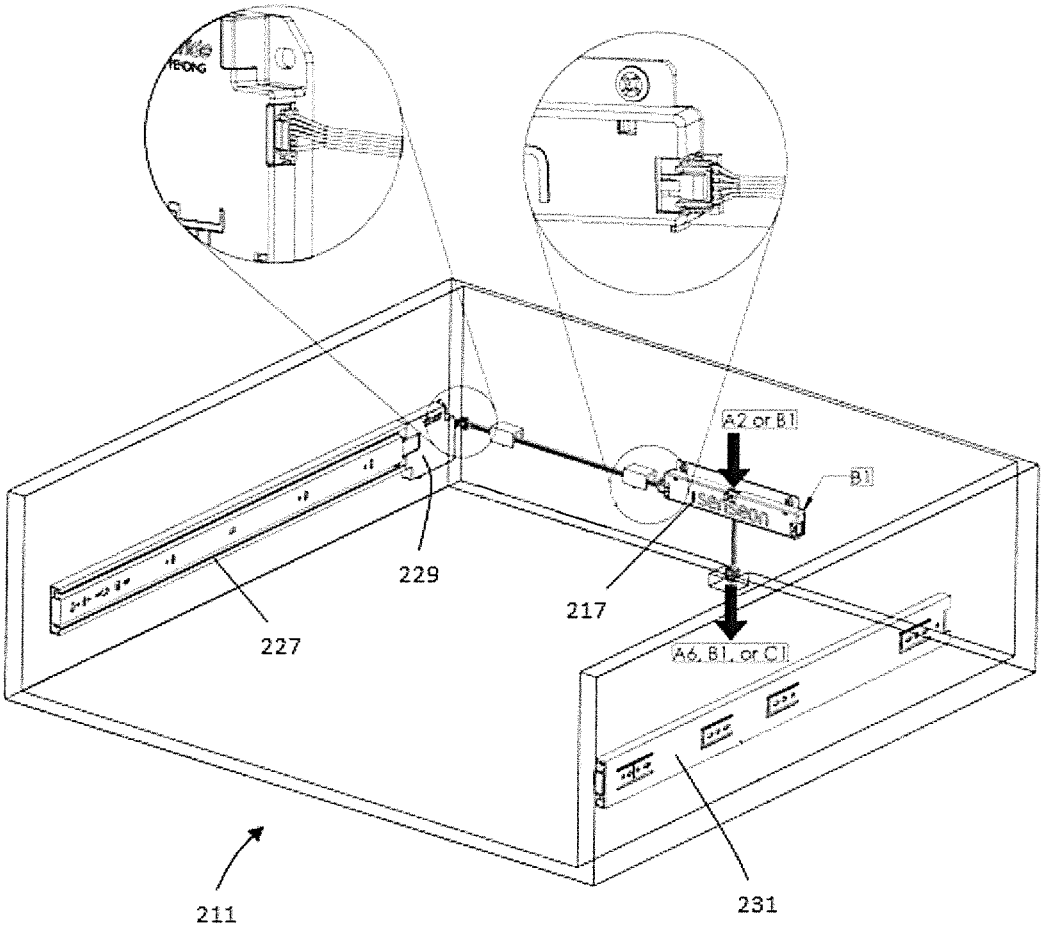
FIG. 2D is an isometric view of a portion of yet another embodiment of a locking system for a cabinet, similar to that of FIG. 2C but utilizing side-mounted telescopic drawer slides, in accordance with aspects of the invention.

FIG. 2D shows another embodiment of the locking system 211, similar to the embodiment of FIG. 2C except utilizing side mounted telescopic drawer slides instead of undermount drawer slides, for example as shown in FIGS. 2A-2C. The drawer slides 227 are side mount drawer slides mounted to opposite side of the cabinet portion. In FIG. 2D, a first side mounted telescopic drawer slide 227 is mounted to a left wall of an opening for a drawer, and a second side mounted telescopic drawer slide 231 is mounted to an opposing right wall. In the illustrated embodiment, a lock mechanism 229 (including a processor in most embodiments) is attached to only the drawer slide 227, to allow for locking the drawer in the closed position. In some embodiments, a lock mechanism 229 may be attached to each of drawer slide 227 and drawer slide 231, for example to more securely hold the drawer in the locked position. As shown in FIG. 2D, the hub 217 is mounted to a rear of the cabinet portion and communicates with the lock mechanism 229 via a cable held against an interior of the cabinet portion by clips and a cable extends from the lower connector port to receive power. The hub 217 can be mounted with fasteners, adhesive, or other attachment devices. A cable can also extend from the upper connector port to communicate with the RFID reader or other hubs 217. The position of the hub 217 can be located anywhere along the cabinet portion interior. As shown, the hub 217 is positioned at about a same level as the drawer slides to reduce the length of the cable coupling the locking mechanism 229 to the hub 217.

Figure 3A:
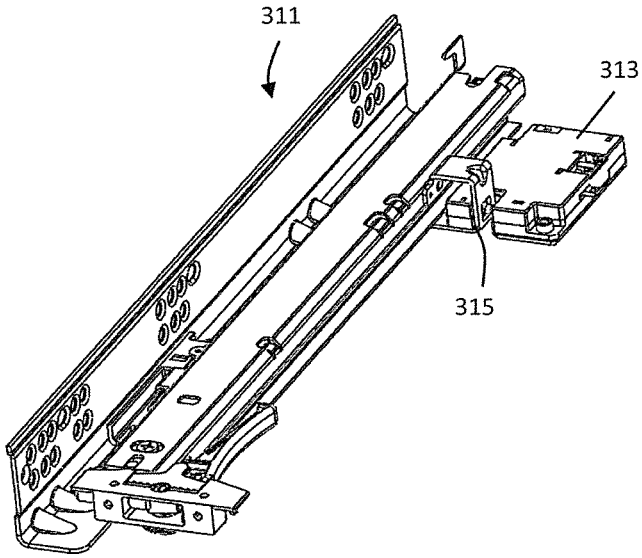
FIG. 3A is an isometric projection view of an embodiment of an electro-mechanical latch/locking device coupled to an undermount drawer slide in accordance with aspects of the invention.

FIG. 3A shows an undermount drawer slide 311 with a lock mechanism 313 in accordance with aspects of the invention. The undermount drawer slide 311 with the lock mechanism 313 may be used, for example, as the drawer slides as discussed with respect to the system of FIG. 1, or more particularly, for the drawer slide and lock of the left side of the cabinet as viewed from the front of the cabinet. The lock mechanism 313 may be, for example, the lock mechanism of FIG. 6, or the same as or similar to the lock mechanism elsewhere discussed herein. In FIG. 3A, the lock mechanism engages a striker or a catch 315 extending from a rear of a drawer or a face plate mounted to the rear of the drawer, or a portion of a drawer slide member that is intended to be mounted to and move with a drawer. In the illustrated embodiment, the striker 315 is mounted to the undermount drawer slide 311. In FIG. 3A the lock mechanism 313 is engaged with the striker 315.

Figure 3B:
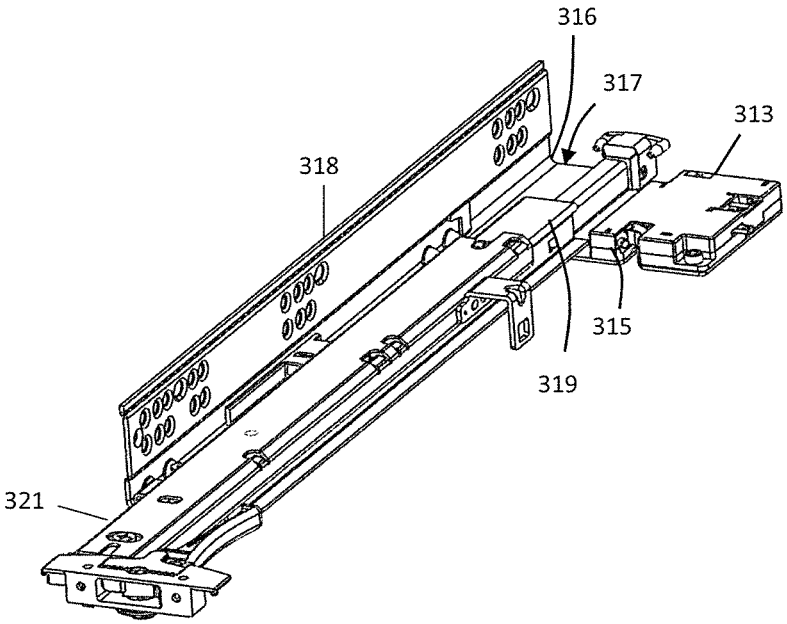
FIG. 3B is similar to FIG. 3A, but shown with the undermount drawer slide in a partially extended position in accordance with aspects of the invention.

FIG. 3B shows the undermount drawer slide 311 in a partially extended state with the striker 315 free of the lock mechanism 313. With the undermount drawer slide 311 in the partially extended state, it may be seen that the lock mechanism 313 can be mounted to a cabinet member 317 of the undermount drawer slide 311. In some embodiments, the lock mechanism 313 is spaced or detached from the cabinet member 317 or the undermount drawer slide 311. The cabinet member 317 includes a flange 318 for mounting to a side wall or structure of a cabinet, with the flange 318 extending out from a longitudinal side of a body 316 of the cabinet member 317. As shown, the flange 318 is perpendicular to the body 316 of the cabinet member 317 but can be at any angle including parallel or coplanar, such as for side mount drawer slides. The lock mechanism 313 is mounted about a rear of the cabinet member. An intermediate slide member 319 is slidably extendable, and in FIG. 3B slightly extended from the cabinet member 317. A drawer slide member 321 is, in turn, slidably extendable, and in FIG. 3B slightly extended from the intermediate slide member 319, with a drawer (not shown) generally mounted to the drawer slide member 321. In operation the drawer slide member 321 may be extended from the intermediate slide member 319, and the intermediate slide member 319 from the cabinet member 317, all in a telescopic fashion. In some embodiments the undermount drawer slide 311 may instead be a two member drawer slide, with the intermediate slide member 319 omitted. In the embodiment of FIG. 3B, the striker 315 is formed of an L-bracket mounted to the drawer slide member 321. In other embodiments, the striker 315 can be any shaped bracket attached to the rear of the drawer or a cabinet door and enter into a cutout of the housing of the lock mechanism 313.

Figure 3C:
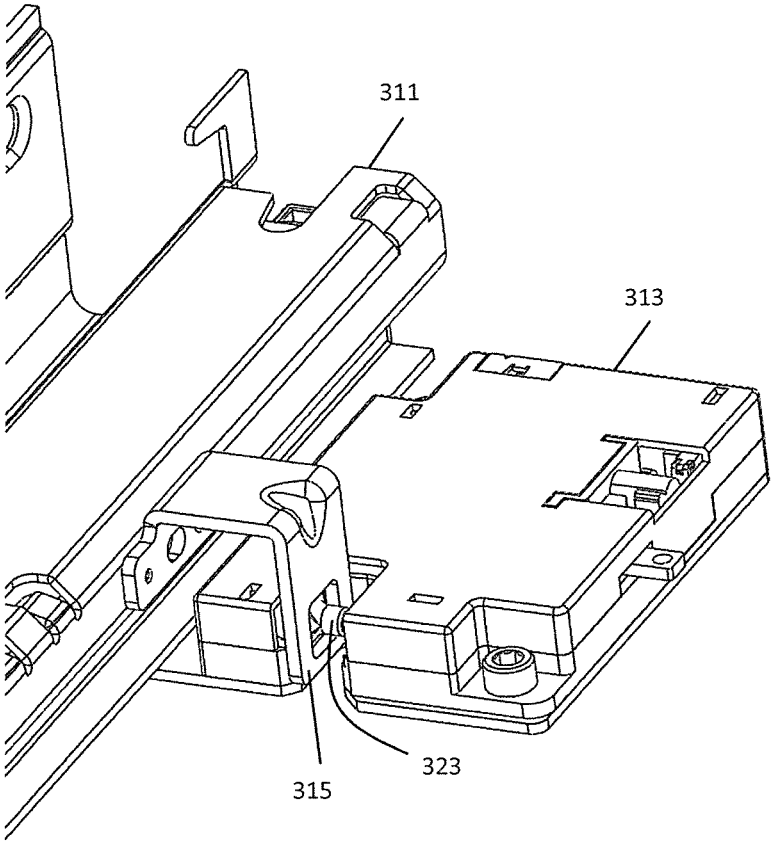
FIG. 3C is an isometric projection close up view of the electro-mechanical device and portion of the undermount drawer slide, shown in FIG. 3A in accordance with aspects of the invention.

FIG. 3C shows a close-up view of portions of the undermount drawer slide 311 with the lock mechanism 313 of FIG. 3A. In FIG. 3C it may be seen that the striker 315 is within the cutout of the housing of the lock mechanism 313, and a tooth 323 of the lock mechanism 313 has engaged the striker 315, thereby locking the drawer slide member 321 in a closed position, by passing through an aperture of the striker 315 or captured between the tooth 323 and the housing of the lock mechanism 313. The tooth 323 may for example be a tooth of a latch receiver of the lock mechanism.

Figure 4A:
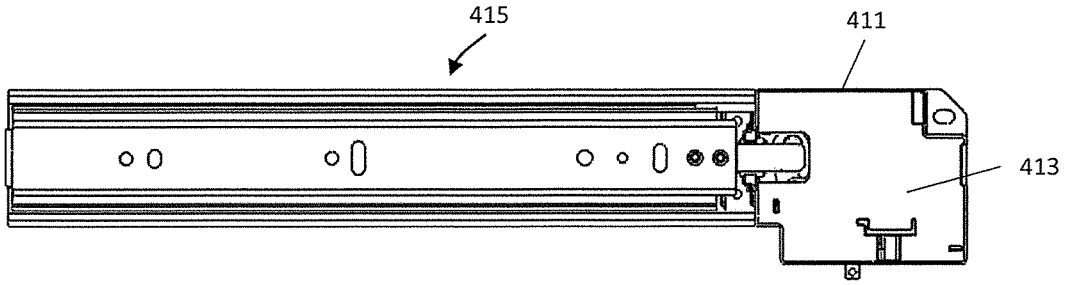
FIG. 4A is a view of another embodiment of the electro-mechanical latch/locking device integrated to a telescopic drawer slide, in accordance with aspects of the invention.

FIG. 4A is a side view of a lock mechanism 411 in accordance with aspects of the invention coupled to a telescopic drawer slide 415. The telescopic drawer slide 415 with the lock mechanism may be used, for example, as the drawer slides as discussed with respect to the system of FIG. 1, or more particularly, for the drawer slide and lock of the left side of the cabinet as viewed from the front of the cabinet. The lock mechanism 411 in various embodiments is the same as, or similar to, the lock mechanism of FIG. 5, or lock mechanisms elsewhere discussed herein. The lock mechanism 411, as shown, includes a cover 413.

Figure 4B:
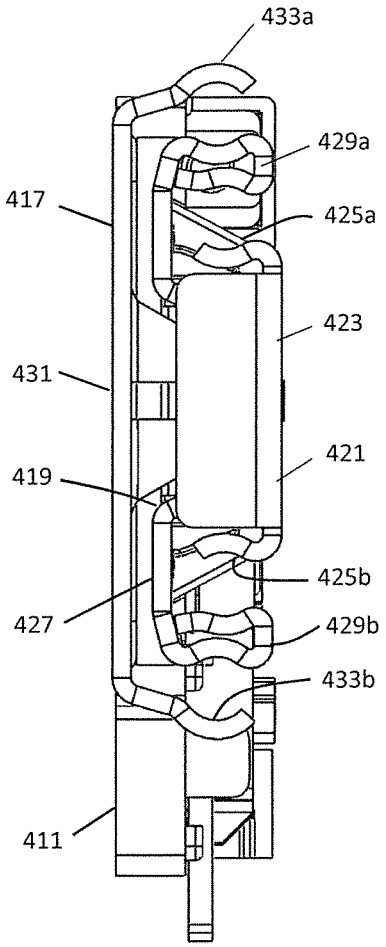
FIG. 4B is a front view of the telescopic drawer slide coupled to a lock of FIG. 4A, in accordance with aspects of the invention.

As illustrated in FIG. 4A, the lock mechanism 411 is mounted to a rear of the telescopic drawer slide 415. As may be seen in the front view of FIG. 4B, the telescopic drawer slide 415 includes an outer slide member 417, an intermediate slide member 419, and an inner slide member 421, with the lock mechanism 411 coupled to a rear of the outer slide member 417. The inner slide member 421 includes a longitudinal web 423, which is longitudinally bounded by arcuate raceways 425*a*, 425*b*. The intermediate slide member 419 similarly has a generally longitudinal web 427 (with an indention in its middle to allow for mounting hardware), also longitudinally bounded by arcuate raceways 429*a*, 429*b*, with the inner slide member 421 nested within the arcuate raceways 429*a*, 429*b*. The arcuate raceways 429*a*, 429*b*, of the intermediate slide member 419 face both towards the inner slide member 421 and the outer slide member 417 for, as may be expected, the intermediate slide member 419 is nested within arcuate raceways 433*a*, 433*b* of the outer slide member 417, with the arcuate raceways 433*a*, 433*b* longitudinally bounding a longitudinal web 431 of the outer slide member. As shown, the arcuate raceways 429*a*, 429*b* at each end of the intermediate slide member 419 face opposite directions. In operation the inner slide member 421 may be extended from the intermediate slide member 419, and the intermediate slide member 419 from the outer slide member 417, all in a telescopic fashion. Of course, in some embodiments the telescopic drawer slide instead may be a two member drawer slide, with the intermediate slide member 419 omitted. Although not shown, generally bearings run in the arcuate raceways.

Figure 5:
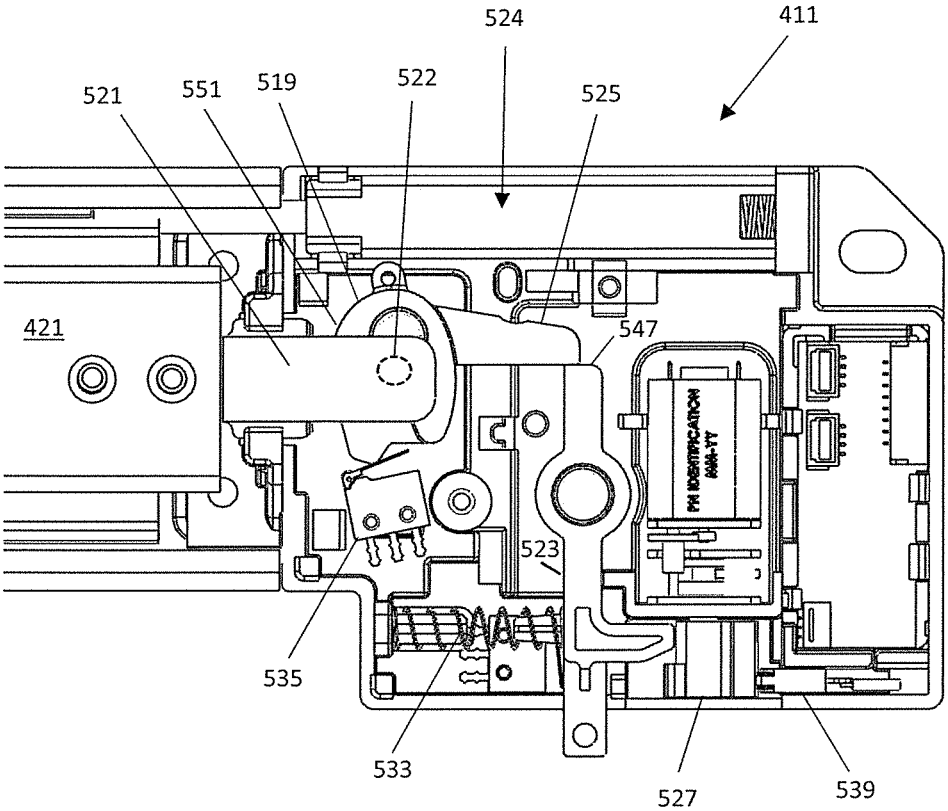
FIG. 5 is a close up view of the electro-mechanical latch/locking device of FIG. 4A with a cover removed, in accordance with aspects of the invention.

FIG. 5 illustrates a close up view of an example embodiment of the lock mechanism 411, or other electro-mechanical latch/locking device, with the cover 413 and the latch spring removed for clarity. In FIG. 5, a tab 521 extends from the inner slide member 421, with a pin 522 protruding from the tab 521 towards the latch receiver 519. The pin 522 is identified by broken lines because it protrudes from a side of the tab 521 not visible in FIG. 5. In the locked position, the pin 522 is engaged with a first leg 551 of the latch receiver 519 and the third leg 525 is resisting against the first end 547 of the lever arm 523 biased by a spring 533. A tip, or flange, of the latch receiver 519 is slightly contacting or about to contact the latch sensor 535, but without changing its state, and the motor cam 527 is contacting the motor cam sensor 539. An optional spring bias mechanism 524 can be used to propel the drawer away from the latch receiver.

Figure 6:
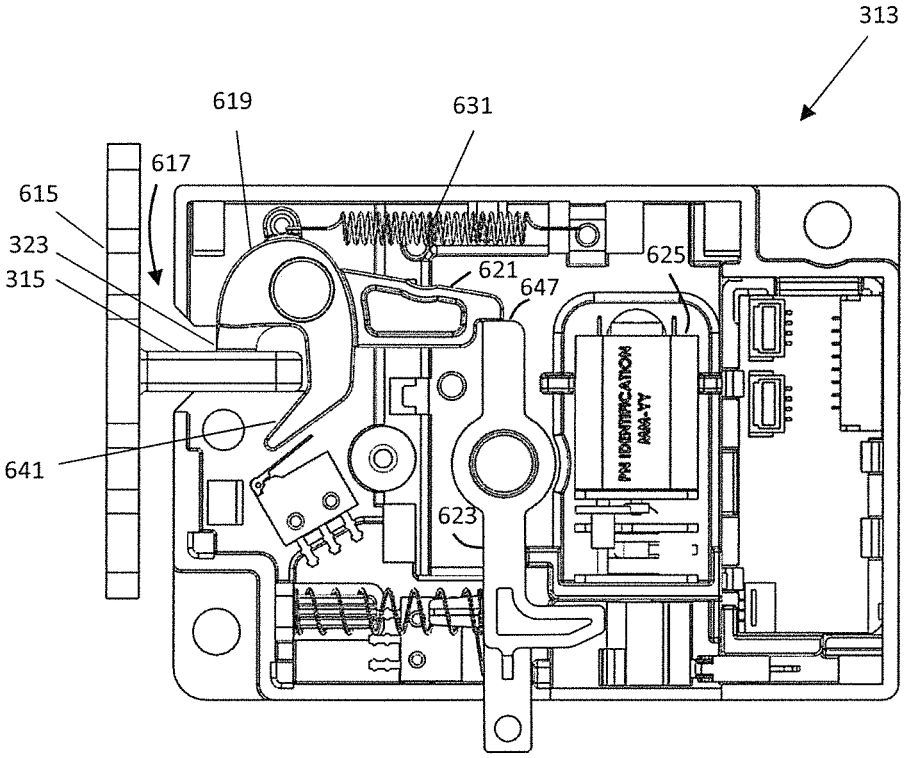
FIG. 6 is a view of a stand-alone electro-mechanical latch/locking device with a cover removed, in accordance with aspects of the invention.

FIG. 6 illustrates a view of a stand-alone electro-mechanical latch/locking device or lock mechanism which may be used for example as the lock mechanism 313 as shown in FIG. 3A or as a lock mechanism for a door of a cabinet. In the embodiment of FIG. 6, a catch or a striker 315 extends from a face plate 615 mounted to a rear of a drawer, or a portion of a drawer slide member that is intended to be mounted to and move with a drawer, or in some embodiments a door of a cabinet. The lock mechanism 313 is coupled to a cabinet, or a drawer slide member that is intended to be mounted to and maintained in position with respect to a cabinet. In most embodiments, the electro-mechanical latch/locking device is dimensioned so as to fit within an operating envelope of the drawer slide, and in some embodiments the electro-mechanical latch/locking device is mounted within the operating envelope of the drawer slide. The operating envelope of the drawer slide is generally a space having a width less than or equal to spacing between a cabinet wall and a drawer and having a height of approximate or less than a height of a drawer. In some embodiments the electro-mechanical latch/locking device is dimensioned to fit within a profile of the drawer slide. In some embodiments, the thickness of the lock mechanism, and/or the components comprising components of the lock mechanism, is approximately ½ inch, although in some embodiments the thickness is ⅜ inch, and in some embodiments the thickness is ¾ inch.

The electro-mechanical latch/locking device includes a latch receiver 619. The latch receiver 619 receives the striker 315 when the drawer slide is in or approximate a closed position. The latch receiver 619 is maintained in a locked position by a lever arm 623, which is moveable between a locking position and an unlocking position by activation of a motor 625. In some embodiments the latch receiver 619 is maintained in the locked position by engagement with a first end 647 of the lever arm 623. In some embodiments, for example as illustrated in FIG. 6, the latch receiver 619 is biased towards an open or unlocked position by a latch spring 631. Movement of the lever arm 623 to the unlocking position, for example using a motor 625 and associated driving mechanism, releases the latch receiver 619 to the unlocked position.

In the embodiment illustrated in FIG. 6, the striker face plate 615, and/or striker 315, can be carried by the drawer or drawer slide member, with the striker 315 extending from the drawer or drawer slide member towards the electro-mechanical latch/locking device. Preferably the striker 315 extends towards the electro-mechanical latch/locking device a distance calculated to allow the striker 315 to move in an unobstructed fashion to engage the latch receiver 619. The striker 315 should also be able to bias against the latch receiver 619 and rotate the latch receiver 619.

The striker 315 may be welded or otherwise attached to the extension of the inner slide member or mounted to the drawer, for example by way of the striker face plate if present, or mounted to a door of a cabinet. In other embodiments, the striker 315 may be formed of the material of the inner slide member, and may, for example, be in the form of a hook or a ring, or other form punched or pressed from the material of the inner slide member.

The electro-mechanical latch/locking device includes components configured to work in combination to capture the striker 315 within the latch receiver 619 and secure the inner slide member or drawer in the closed or locked position. Conversely, the components of the electro-mechanical latch/locking device may also be activated to release the striker 315 from the latch receiver 619 and thus, release the inner slide member or drawer to allow it to return to the open position. The latch receiver 619 captures the striker 315, such that the striker 315, and therefore the inner slide member or the drawer, is prevented from moving to an open position. Thus, the striker 315 and the latch receiver 619 may together be considered a latch.

The latch receiver 619 is rotatably mounted using a screw or rivet to a housing base. Alternately, in some embodiments the electro-mechanical latch/locking device, or in some embodiments the latch receiver 619, locking arm 623, and associated components may be mounted to an outer slide member or a cabinet frame. The latch receiver 619 is generally U-shaped, defined by two legs that extend from the latch receiver, a first leg and a second leg 641, with the first leg and the second leg 641 defining a basin there between for receiving the striker 315. The first leg can also be the tooth 323 engaging with the striker 315. The first leg is configured to slip into engage with the striker 315 forming a latch. In one embodiment, the striker 315 is shaped as a hook or a ring to receive the first leg which is shaped as a cylinder. The shape and structure of the striker 315 and the first leg is not limited, as long as the first leg can be rotated and engage with the striker 315 in the closed position, which prevents the drawer from opening. A third leg 621 extends from one side of the of the generally U-shaped latch receiver 619 approximately perpendicular to the basin. In one embodiment, the third leg 621 extends straight from the latch receiver 619, and in some embodiments, has a notch to receive the first end 647 of the lever arm 623. An optional spring bias mechanism as shown in the lock mechanism 411 of FIG. 5 can be used to propel the catch or striker away from the latch receiver 619.

Figure 7:
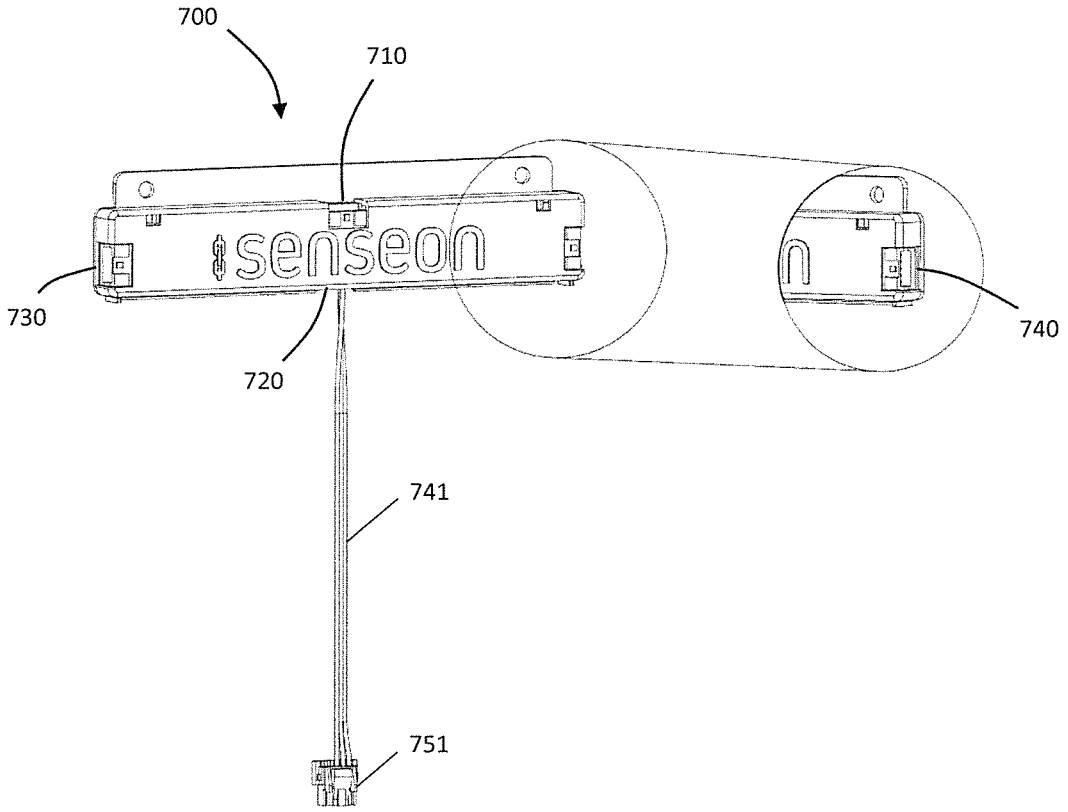
FIG. 7 illustrates an example hub in accordance with aspects of the invention.

FIG. 7 is a stand-alone view of a hub 700 in accordance with aspects of the invention. The hub of FIG. 7 may be used as the hub of FIGS. 1 and 2A-D in various embodiments, and may be used to distribute signals to electro-mechanical devices, for example, the electro-mechanical latch/locking device as discussed with respect to FIG. 5 or 6, or other electro-mechanical latch/locking devices discussed elsewhere herein.

Referring to FIG. 7, the hub 700 includes three connection ports: a top connection port 710, a left connection port 730, and a right connection port 740 (with a close up view). In addition, an extendable cable 711, extending from a bottom portion 720 of the hub, effectively provides a fourth connection port by way of a connector 751 of a distal end of the cable. In various embodiments a bottom connection port may be provided instead of a cable. Each of the connection ports (and connector 751), in various embodiments, may include pins configured to link with one or more devices using a cable. In some embodiments, the top connection port 710 is configured to link, or pass information of an authentication device such as a device equipped with a keypad, RFID reader, biometric, near field communication (NFC), or any other device used to authenticate user access. In other embodiments, the top connection port is configured to link to another hub, similar to or the same as the hub 700 as shown in FIG. 7. In some embodiments the top connection port may not be connected to a device. For example, the top connection port may be connected to a first connector of a hub cable, with the hub cable having a second connector connected to a capping plug.

The bottom cable, or connection port if so provided, in some embodiments is coupled to a power supply providing power to the hub 700. In some embodiments, the bottom cable or connection port instead is connected to another hub for linking a plurality of hubs together. The bottom connection port for example may be connected to a top connection port (similar to or same as the top connection port 710) of the other hub, and relay or provide the signal received from the authentication device to the other hub.

The left connection port 730 and the right connection port 740, in some embodiments, are connected to electro-mechanical devices, for example by way of cables. For example, the left connection port 730 may be connected to a first electro-mechanical device (not shown) and the right connection port 740 may be connected to a second electro-mechanical device (also not shown). The left and right connection ports may respectively provide power to the electro-mechanical devices by providing or relaying power provided by the power supply to the electro-mechanical devices. Additionally, the left and right connection ports may respectively provide the signal received from the authentication device to the electro-mechanical devices.

In some embodiments the first electro-mechanical device may provide to the left connection port a lock sensor signal, for example which may indicate whether or not a lock connected to the left connection port has been tampered with. The hub, in turn, may forward or relay the lock sensor signal to the second electro-mechanical device, via the right connection port, for the second electro-mechanical device to detect if there is a tamper of the first electro-mechanical device has occurred and perform a reaction or series of reactions if the tamper has occurred. Additionally, in some embodiments, the first electro-mechanical device may provide to the left connection port a drawer or tandem sensor signal for the hub to forward or relay the drawer or tandem sensor signal to the second electro-mechanical device, again via the right connection port, for the second electro-mechanical device to perform locking and unlocking operations. In various embodiments, the first electro-mechanical device may instead or in addition provide to the left connection port a lever sensor signal for the hub to transfer the lever sensor signal to the second electro-mechanical device for controlling operations of a lever arm of the second electro-mechanical device. In some embodiments, the first and second electro-mechanical devices may be a lock, which may be a cabinet lock for a door or drawer slide.

Although the discussion above discusses the first electro-mechanical device providing various signals to the hub, and the hub in turn forwards or relays the signals to the second electro-mechanical device, it should be understood that in various embodiments the opposite or vice versa is also true. That is, the various signals discussed above (e.g., the lock sensor signal, drawer or tandem sensor signal, lever sensor signal) may be provided instead by the second electro-mechanical device to the hub which in turn forward or relay such signals to the first electro-mechanical device to perform the above-discussed operations.

Accordingly, in many embodiments the hub is passive and generally forwards signals from one electro-mechanical device to another, and forwards activation signals and power signals to the electro-mechanical devices and other hubs. However, in some embodiments the hub may be active such that it may amplify the signals prior to forwarding them to the other electro-mechanical device. In either case, in some embodiments the top and bottom connection ports each include three connection points, two for power and one for an activation signal, and the left and right connection ports each include five connection points, two for power, one for an activation signal, one for passing a signal from a left electro-mechanical device to a right electro-mechanical device, and one for passing a signal from the right electro-mechanical device to the left electro-mechanical device.

Figure 8:
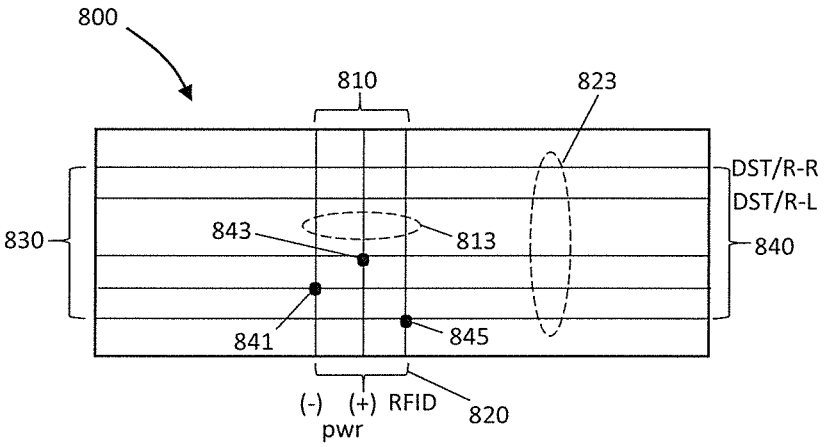
FIG. 8 is a semi-schematic of a hub in accordance with aspects of the invention.

FIG. 8 is a diagram showing signal routing of a hub in accordance with aspects of the inventions. In some embodiments the signal routing may be incorporated into the hub 700 as discussed with respect to FIG. 7.

Referring to FIG. 8, a hub 800 includes a first set of signal paths 813 and a second set of signal paths 823. The first set of signal paths extends from a top edge to a bottom edge of the hub, and the second set of signal paths extends from a left edge to a right edge of the hub. In some embodiments the first set of signal paths couple a top connector port and a bottom connector port, and the second set of signal paths couple a left connector port and a right connector port. In some embodiments only some, some, or all of the first signal paths and the second signal paths are coupled to one another. In some embodiments the signal paths are provided on a circuit board. In some such embodiments the first set of signal paths are on one layer of the circuit board, the second set of signal paths are on another layer of the circuit board, and connections, if any, between a signal path of the first set and a signal path of the second set is by way of a metallized via connecting the two paths. In some embodiments, active elements, for example amplifying transistor circuits, are also included for amplifying at least some of the signals on signal paths.

As shown in FIG. 8, the first set of signal paths 813 includes a negative power signal path, which may be referred to as pwr(−), a positive power signal path, which may be referred to as pwr(+), and an authentication signal path, which may be referred to as a RFID signal path. The pwr(−) and pwr(+) signal paths of the first set of signal paths generally serve to provide or relay power received from a power supply to provide power to an authentication device. In some embodiments the RFID signal path of the first set of signal paths serves to provide or relay an authentication signal received from the authentication device to another hub.

In some embodiments, and as illustrated in FIG. 8, the first set of signal paths and second set of signal paths may include signal paths that are coupled together. For example, as shown in FIG. 8, the pwr(−), pwr(+), and RFID signal paths of the first set of signal paths intersect signal paths of the second set of signal paths to form nodes 841, 843, and 845. As such, the second set of signal paths 823 also includes a negative power signal path, or pwr(−), a positive power signal path, or pwr(+), and an authentication signal path, or RFID. The second set of signal paths further includes a right drawer switch touch/release signal path (which may be referred to as DST/R-R) and a left drawer switch touch/release signal path (which may be referred to as DST/R-L).

The pwr(−) and pwr(+) signal paths of the second set of signal paths generally serve to provide power to electro-mechanical devices. For example, when the power supply provides power to the pwr(−) and pwr(+) signal paths of the first set of signal paths, such power is also provided to the pwr(−) and pwr(+) signal paths of the second set of signal paths by way of the nodes 841 and 843. In some embodiments the RFID signal path of the second set of signal paths serves to pass the authentication signal received from the authentication device to the electro-mechanical devices. For example, when the RFID signal path of the first set of signal paths receives the authentication signal from the authentication device, such authentication signal also passes to the RFID signal path of the second set of signal by way of the node 845.

The DST/R-R and DST/R-L signal paths, of the second set of signal paths, in some embodiments may allow synchronic activation of the electro-mechanical devices. For example, if one electro-mechanical device is independently or both together activated, both electro-mechanical devices will be activated and provide position feedback. In more detail, the DST/R-R signal path may pass or forward a drawer sensor or switch signal from a first electro-mechanical device to a second electro-mechanical device to perform locking and unlocking operations of both the first electro-mechanical device and the second electro-mechanical device. Likewise, in some embodiments, the DST/R-L signal path may pass or forward a drawer sensor or switch signal from the second electro-mechanical device to the first electro-mechanical device to perform such locking and unlocking operations of both the first electro-mechanical device and the second electro-mechanical device. In various embodiments, the second set of signal paths may include additional signal paths coupling the left and right connection ports, for example to allow for communication of all of the signals just discussed above.

As illustrated in FIG. 8, the first and second sets of signal paths may form sets of pins at edges of the hub 800. For example, the first set of signal paths may form a first pin set 810 at the top edge of the hub and a second pin set 820 at the bottom edge of the hub. In some embodiments the first and second pin sets may be incorporated into connection points such as the top connection port 710 and bottom connection port 720 of FIG. 7 respectively. In some embodiments the second set of signal paths may form a third pin set 830 and a fourth pin set 840 at the left and right edges of the hub respectively. The third and fourth pin sets in some embodiments may be incorporated into connection points such as the left connection port 730 and right connection port 740 of FIG. 7.

In some embodiments other signal paths may be provided. For example, the hub may include a lock sensor signal path for passing a lock sensor signal from one electro-mechanical device to another. The lock sensor signal may indicate whether or not a tamper has occurred. In some embodiments the hub may further include a drawer or tandem sensor signal path for passing a drawer or tandem sensor signal from one electro-mechanical device to another in order to perform locking and unlocking operations. In yet another embodiment the hub may include a lever sensor signal path for passing a lever sensor signal from one electro-mechanical device to another for controlling operations of a lever arm in an electro-mechanical device.

In many embodiments the hub is passive and generally passes signals from one electro-mechanical device to another. However, in some embodiments the hub may be active by having an amplifier for amplifying the signals prior to passing them to the other electro-mechanical device. In some embodiments the signal paths of the first and second sets of signal paths are wire traces on a printed circuit board (PCB). In some embodiments the wire traces are formed with copper or other types of conductive material.

Figure 9:
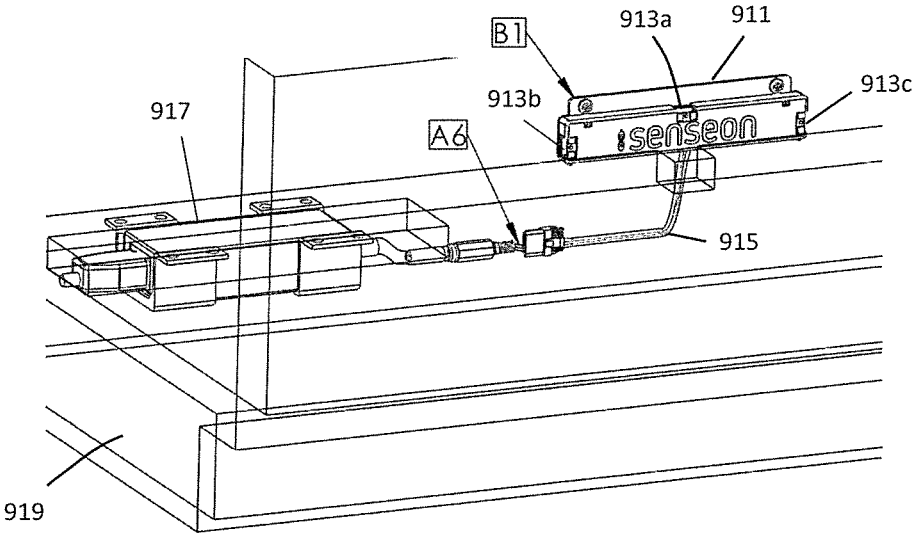
FIG. 9 illustrates a hub connected to a power converter in a cabinet in accordance with aspects of the invention.

FIG. 9 is a view of a hub 911 connected to a power converter 917 mounted at a bottom panel of a cabinet, in accordance with aspects of the invention. In some embodiments the hub is the hub 700 as discussed with respect to FIG. 7.

Referring to FIG. 9, the hub 911 is mounted to a rear panel of a cabinet 919, by way of screws as illustrated. The hub includes a first connection socket 913*a*, a second connection socket 913*b*, and a third connection socket 913*c*. A cable 915 also extends from the hub, with the cable effectively providing a fourth connection socket. The connection sockets may be considered ports of the hub. In some embodiments the hub may include a fourth connection socket, instead of the cable, for example. In most embodiments connection points of the first and fourth connection sockets are connected by signal paths within the hub, as are some of the connection points of the second and third connection sockets. The hub may therefore be considered as having vertical signal paths and horizontal signal paths. In addition, the vertical signal paths are also cross coupled to other of the connection points of the horizontal connector sockets.

FIG. 9 further shows the cable 915 having a first end connected to the hub and a second end connected to a socket of a power converter 917. In some embodiments the first end of the cable is connected to the fourth connection socket of the hub.

The power converter 917 generally converts AC utility or line power to DC power, although in some embodiments the power converter may be a DC-DC converter, and the power supply may be for example a battery. In many embodiments, the power converter is effectively coupled to one of the connection sockets of the hub, for example the fourth connection socket, and an RFID reader is effectively coupled to another connection socket of the hub, for example the first connection socket. Each of the second and third connection sockets in some embodiments may be effectively coupled to a lock or an electro-mechanical device, which may be for drawer slides.

As shown in FIG. 9, the power converter is mounted to a bottom panel of the cabinet 919 with the cable 915 routing under the bottom panel into the hub. In some embodiments access holes may be used to route the cable through the bottom panel. In some embodiments the cable may be routed to the hub within the cabinet, and thus eliminating the need for the access holes.

In operation, the power converter provides power, for example DC power, to the hub and in turn, the hub provides power to the RFID reader and locks or electro-mechanical devices connected to the second and third connection sockets. The hub in some embodiments may receive a trigger signal from the RFID reader and passes the trigger signal, by way of one of the horizontal signal paths, to the locks or electro-mechanical devices connected to the second and third connection sockets.

Figure 10A:
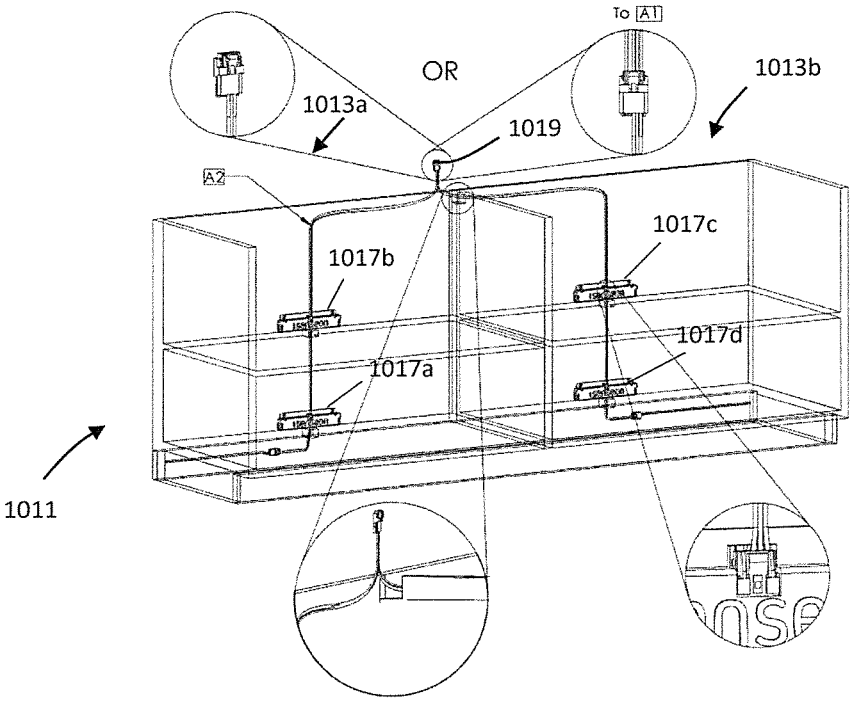
FIG. 10A illustrates an example layout of hubs for a portion of a cabinet in accordance with aspects of the invention.

FIG. 10A illustrates an example layout of hubs for a portion of a cabinet in accordance with aspects of the invention. In the example of FIG. 10A, a cabinet includes a pair of upper and lower openings arranged in a side-by-side manner, with a left side 1013*a* having an upper and lower opening and right side 1013*b* having an upper and lower opening. In various embodiments the openings may be used for drawers extendably supported by drawer slides, or simply a space accessibly by way of a door, or some combination of both.

The drawer slides or doors would include each include locks with processors for control, with hubs distributing power and activation signals, and in some embodiments lock status signals, to the locks. For this purpose, the portion of the cabinet includes a hub 1017*a* for the lower left side opening, a hub 1017*b* for the upper left side opening, a hub 1017*c* for the upper right side opening, and a hub 1017*d* for the lower right side opening. The hubs are connected serially, or in a daisy chain manner, with the hub 1017*a* connected to the hub 1017*b*, which in turn is connected to the hub 1017*c*, which further in turn is connected to the hub 1017*d*. Although not shown, each of the hubs would also be connected to one or more locks used for securing access to their respective openings.

In the embodiment of FIG. 10A, either the hub 1017*a* or the hub 1017*d*, at either end of the illustrated chain of hubs, may be connected to a power source, or connected to still further hubs, one of which is connected to the power source. In addition, in the embodiment of FIG. 10A two cables are used to connect the hub 1017*b* and the hub 1017*c*. The two cables may be connected either by a capping plug, which simply connects the two cables, or by a connector to an RFID reader, with the connector both connecting power signal paths of the cables together and providing a separate RFID activation signal path to each of hub 1017*b* (and hence also hub 1017*a*) and hub 1017*c* (and hence hub 1017*d*).

Figure 10B:
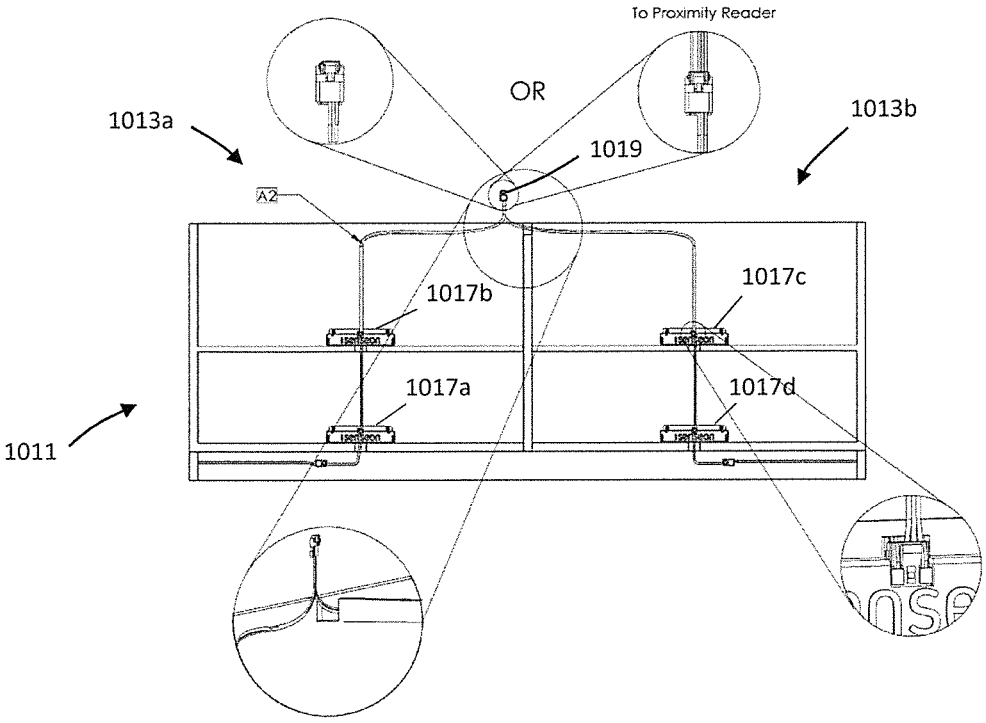
FIG. 10B illustrates a front view of the portion of the cabinet of FIG. 10A in accordance with aspects of the invention.

FIG. 10A shows the hubs mounted to a rear wall of the portion of the cabinet. As may be seen in FIG. 10B, which illustrates a front view of the portion of the cabinet of FIG. 10A, the hubs are also mounted near a bottom of their respective openings.

Figure 11A:
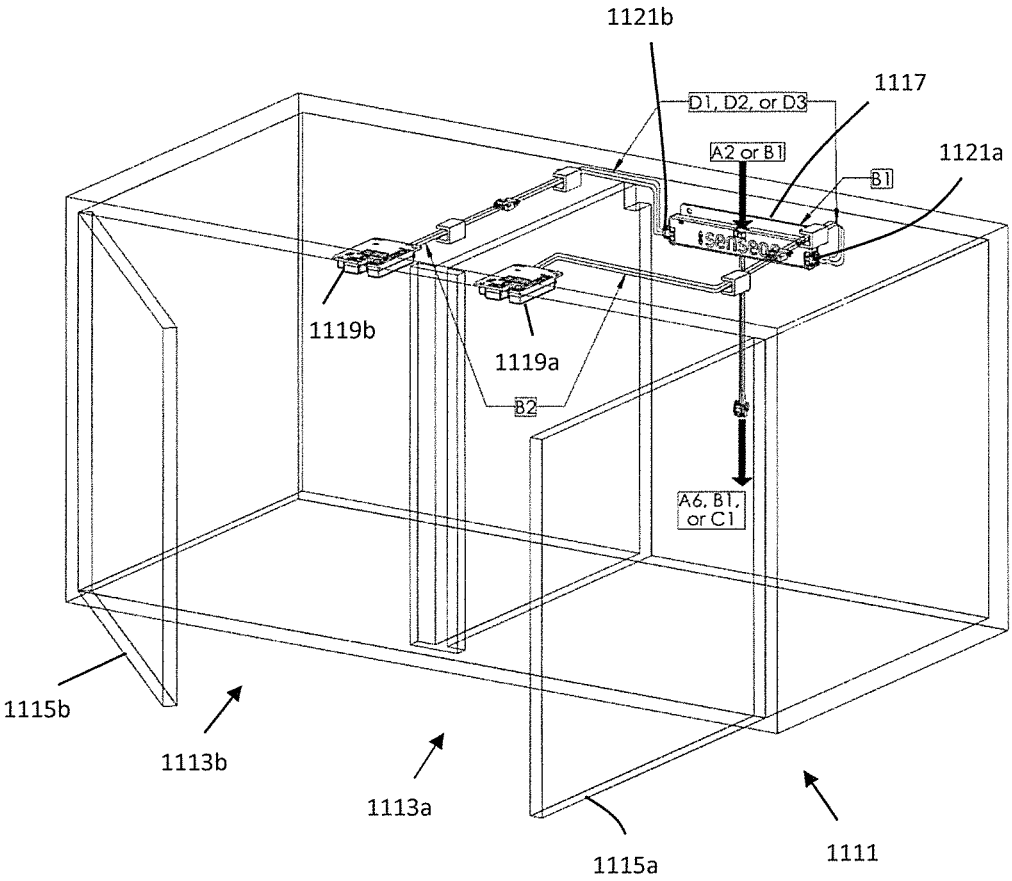
FIG. 11A illustrates a further portion of a cabinet with portions of a locking system in accordance with aspects of the invention.

FIG. 11A illustrates a further portion of a cabinet 1111 with portions of a locking system in accordance with aspects of the invention. The portion of the cabinet shown in FIG.

11A includes two doors 1115*a* and 1115*b*, side-by-side, restricting access to a right side cabinet opening 1113*a* and a left side cabinet opening 1113*b*, respectively.

The portion of the cabinet includes a single hub 1117, mounted at a rear of the right side cabinet opening. The hub would generally have an upper port coupled to an RFID reader, perhaps through one or more other hubs, and a lower port coupled to a power source, again perhaps through one or more other hubs. As shown in FIG. 11A, a right side port 1121*a* of the hub is connected, by a cable, to a standalone lock 1119*a* for use in locking the right side door 1115*a*. The standalone lock 1119*a* is shown in FIG. 11A as mounted to an underside of a top surface of the right side opening. The standalone lock 1119*a* includes a processor for control purposes, and may be, for example, the lock of FIG. 6. Also as shown in FIG. 11A, a left side port 1121*b* of the hub is connected, by another cable, to another standalone lock 1119*b* for use in locking the left side door 1115*b*. Similar to the standalone lock 1119*a* on the right side, the standalone lock 1119*b* on the left side is shown in FIG. 11A as mounted to an underside of a top surface of the left side opening. The standalone lock 1119*b* also includes a processor for control purposes, and also may be, for example, the lock of FIG. 6.

Figure 11B:
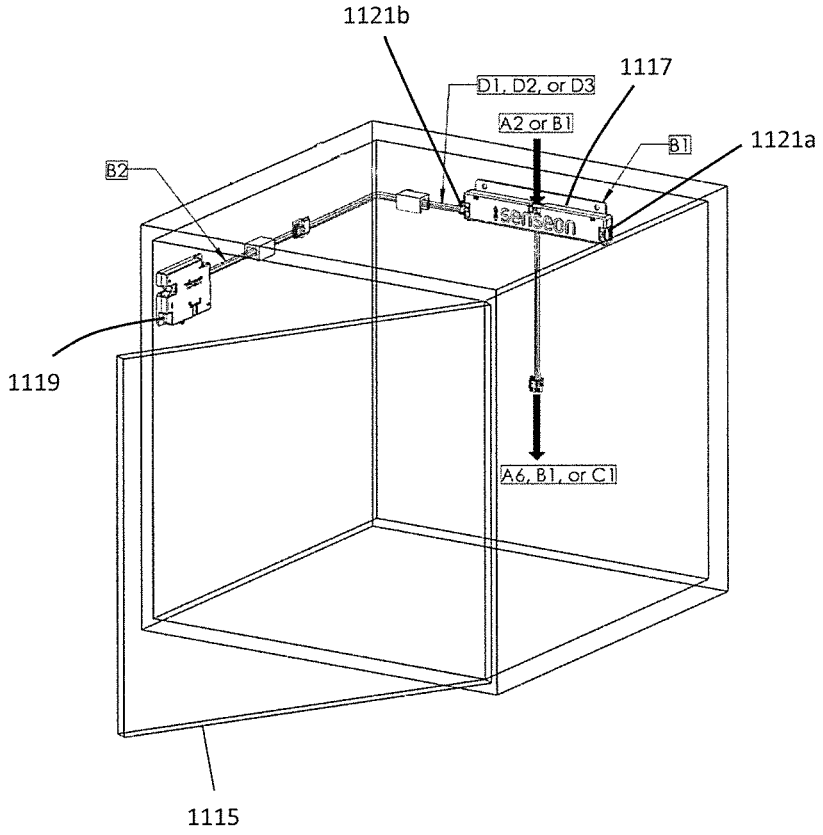
FIG. 11B illustrates a single opening of a cabinet, with access restricted by a door 1115, with portions of a locking system in accordance with aspects of the invention.

FIG. 11*b* illustrates a single opening of a cabinet 1111, with access restricted by a door 1115, with portions of a locking system in accordance with aspects of the invention. A hub 1117 is mounted at a rear of the opening. Although not explicitly shown, the hub receives an RFID activation signal and power signals, by way of the hubs upper and/or lower ports, for example. A right side port 1121*a* of the hub is left open, namely not connected to a cable. A left side port 1121*b* of the hub is connected by a cable to a lock 1119. The lock 1119, shown in FIG. 11B as mounted to a side wall of the single opening, is used to lock the door 1115. The lock includes a processor for control purposes, as discussed with respect to other locks herein, and, for example, may be the lock of FIG. 6.

Figure 12:
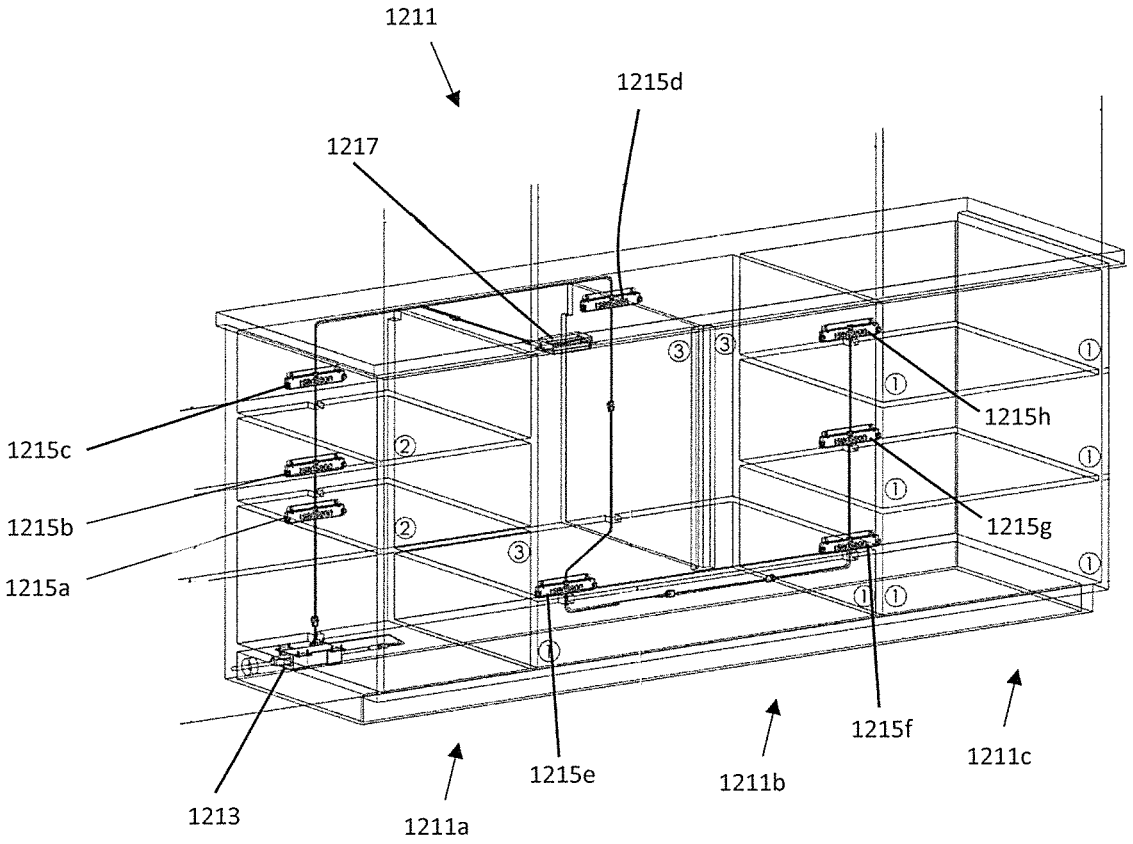
FIG. 12 illustrates a further cabinet with portions of a lock system, with lock devices omitted for clarity, in accordance with aspects of the invention.

FIG. 12 illustrates a further cabinet 1211 with portions of a lock system in accordance with aspects of the invention. The cabinet includes a left set of openings 1211*a* (with three openings), a central set of openings 1211*b* (with two openings), and a right set of openings 1211*c* (with three openings). Each of the openings includes a corresponding hub, namely one of hubs 1215*a-h*, for distribution of power and RFID activation signals to locks (not shown in FIG. 12) used to control access to the respective openings.

In FIG. 12, a power converter is installed in the cabinet in a lower left opening, with the power converter coupled by a cable to the hub 1215*a* in the lowermost left opening. The hub 1215*a* is in turn connected by a cable to hub 1215*b*, for a middle left opening, which in turn is connected to hub 1215*c* for an upper left opening. The hub 1215*c* is connected to hub 1215*d*, for an upper central opening, by way of two cables, with the hub 1215*d* also connected by a cable to hub 1215*e*, for a lower central opening. The hub 1215*e* is connected by a cable to hub 1215*f*, for a lower right opening, which in turn is connected by a cable to hub 1215*g*, for a middle right opening, which also in turn is connected by a cable to hub 1215 for an upper right opening.

The hubs 1215*a-h* are therefore connected serially in a daisy chain manner, with power from the power converter 1213 being passed serially from hub to hub (and from each hub to locks connected to that hub).

Although the invention has been discussed with respect to various embodiments, it should be recognized that the invention comprises the novel and non-obvious claims supported by this disclosure.

What is claimed is:

1. A locking system for a cabinet comprising:

an authentication device;

a power converter;

at least one hub coupled between the authentication device and the power converter, each of the at least one hub including a plurality of ports, the plurality of ports including ports for passage of power signals and an authentication device activation signal, and ports for passage of drawer slide activation signals;

at least one pair of drawer slides, each pair in the at least one pair of drawer slides including a first drawer slide and a second drawer slide, each pair of the at least one pair of drawer slides being coupled to a corresponding same drawer; and a locking mechanism for each first drawer slide and each second drawer slide of the at least one pair of drawer slides, each locking mechanism electrically coupled to a corresponding one of the plurality of ports of the at least one hub, each locking mechanism including a housing and a processor for controlling operation of a lock of the locking mechanism;

wherein the at least one hub is configured to pass a lock status activation signal from the processor of a first locking mechanism of the first drawer slide of the at least one pair of drawer slides to the processor of a second locking mechanism of the second drawer slide of the at least one pair of drawer slides for synchronized activation of the first and second locking mechanisms.

2. The locking system of claim 1, wherein the authentication device comprises an RFID reader, and the authentication device activation signal comprises an RFID activation signal.

3. The locking system of claim 1, wherein the at least one hub comprises a plurality of hubs.

4. The locking system of claim 3, wherein the at least one pair of drawer slides comprises a plurality of pairs of drawer slides.

5. The locking system of claim 4, wherein the plurality of ports in each of the plurality of hubs includes a first port, a second port, a third port, and a fourth port.

6. The locking system of claim 5, wherein each hub is configured to pass a first signal from the first port to all of the second port, third port, and fourth port.

7. The locking system of claim 6, wherein each hub is configured to pass a second signal from the second port to all of the first port, third port, and fourth port.

8. The locking system of claim 7, wherein each hub is configured to pass a third signal from the third port to the fourth port, and to pass a fourth signal from the fourth port to the third port.

9. The locking system of claim 8, wherein the third signal is a drawer slide lock activation signal from the lock mechanism for the first drawer slide of the pair of drawer slides coupled to the third port of a particular one of the plurality of hubs, and the fourth signal is a drawer slide lock activation signal from the lock mechanism for the second drawer slide of the pair of drawer slides coupled to the fourth port of the particular one of the plurality of hubs.

10. The locking system of claim 6 wherein the first port of at least one of the hubs is the port coupled to the authentication device, and the first signal is the authentication device activation signal.

11. The locking system of claim 5, wherein the second port of at least one of the hubs is the port that is coupled to the power converter, and each hub is configured to pass the power signals from the second port to all of the first port, third port, and fourth port.

12. The locking system of claim 3, wherein each of the plurality of hubs includes a first set of signal paths from a top edge of the hub to the bottom edge of the hub, and includes a second set of signal paths from a left edge of the hub to a right edge of the hub, with at least some of the signal paths of the first set of signal paths coupled to at least some of the signal paths of the second set of signal paths.

13. The locking system of claim 1, wherein the lock status signal indicates whether the locking mechanism of the first drawer slide is in an unlocked state.

14. The locking system of claim 1, wherein the lock status signal indicates whether a drawer coupled to the first drawer slide has been pressed inward.

15. The locking system of claim 1, wherein each processor of each locking mechanism is configured to transmit a signal to drive or bias a lever arm between a locking position and an unlocking position in response to receipt of the activation signal.

16. A locking system for a cabinet comprising:

an authentication device;

a power converter;

at least one hub coupled between the authentication device and the power converter, the at least one hub including a first port, a second port, a third port, and a fourth port, with the first port coupled to the authentication device and the second port coupled to the power converter; and a plurality of locks, each of the plurality of locks being at least partially controlled by at least one processor for use in control of the plurality of locks, with each of the plurality of locks coupled to a one of the at least one hub;

wherein the third port of a particular hub of the at least one hub is coupled to a first lock, of the plurality of locks, and the fourth port of the particular hub of the at least one hub is coupled to a second lock, of the plurality of locks;

wherein the at least one hub is configured to pass a first signal from the first lock via the third port to the second lock via the fourth port, and is configured to pass a second signal from the second lock via the fourth port to the first lock via the third port; and wherein the second lock is configured to unlock upon receipt of the first signal and the first lock is configured to unlock upon receipt of the second signal.

17. The locking system of claim 16, wherein the at least one hub comprises a plurality of hubs, and wherein each of the plurality of hubs is coupled to at least one of the plurality of locks.

18. The locking system of claim 17, wherein each particular hub of the plurality of hubs is configured to pass a third signal from the first port of the hub to the second port, the third port and the fourth port of the at least one hub.

19. The locking system of claim 18, wherein the third signal is an access control input activation signal.

20. The locking system of claim 19, wherein the fourth signal is a power signal.

21. The locking system of claim 17, wherein each particular hub of the plurality of hubs is configured to pass a fourth signal from the second port of the particular hub to the first port, the third port, and the fourth port of the particular hub.

22. The locking system of claim 17, wherein the first signal is a first drawer slide lock status signal, and the second signal is a second drawer slide lock status signal.

23. A locking system for a cabinet, comprising:

an authentication device;

a power converter;

a plurality of hubs, each of the hubs including a plurality of ports interconnected by pre-defined signal paths, at least one of the plurality of hubs coupled between the authentication device and the power converter; and a plurality of locks coupled to the plurality of hubs, each lock at least partially controlled by at least one processor for use in control of the locks, wherein the pre-defined signal paths of each hub includes a first set of signal paths which interconnect a first port of the plurality of ports and a second port of the plurality of ports and a second set of signal paths which interconnect a third port of the plurality of ports and a fourth port of the plurality of ports;

wherein at least some of the first set of signal paths are coupled to at least some of the second set of signal paths;

wherein at least some of the second set of signal paths are not coupled to the first set of signal paths, and wherein the plurality of locks are coupled to the third port and the fourth port of the plurality of hubs.

24. The locking system of claim 23, wherein the first port and the second port are on first opposing sides of each hub, and the third port and the fourth port are on second opposing sides of each hub.

25. The locking system of claim 23, wherein the first set of signal paths are on a first layer of a printed circuit board, and the second set of signal paths are on a second layer of the printed circuit board.

26. The locking system of claim 23, wherein the first set of signal paths additionally interconnect the first port of the plurality of ports and the third and fourth ports of the plurality of ports.

* * * * *